US005534326A

United States Patent [19]

Trokhan et al.

[11] Patent Number: 5,534,326

[45] Date of Patent: Jul. 9, 1996

[54] CELLULOSIC FIBROUS STRUCTURES HAVING DISCRETE REGIONS WITH RADIALLY ORIENTED FIBERS THEREIN, APPARATUS THEREFOR AND PROCESS OF MAKING

[75] Inventors: Paul D. Trokhan, Hamilton; Dean Van Phan; Larry L. Huston, both of West Chester, all of Ohio

[73] Assignee: The Procter & Gamble Company, Cincinnati, Ohio

[21] Appl. No.: 163,498

[22] Filed: Dec. 6, 1993

Related U.S. Application Data

[63] Continuation of Ser. No. 922,436, Jul. 29, 1992, abandoned.

[51] Int. Cl.[6] ..... B32B 3/10; B32B 7/02; B32B 5/16; D04H 1/58

[52] U.S. Cl. ..... 428/131; 428/218; 428/288; 428/326; 428/327; 428/338; 428/339

[58] Field of Search ..... 428/326, 327, 428/338, 339, 131, 218, 288

[56] References Cited

U.S. PATENT DOCUMENTS

| | | | |
|---|---|---|---|
| 1,699,760 | 1/1929 | Sherman . | |
| 2,862,251 | 12/1958 | Kalwaites | 19/161 |
| 2,902,395 | 9/1959 | Hirschy et al. | 161/57 |
| 3,034,180 | 5/1962 | Greiner et al. | 19/155 |
| 3,072,511 | 1/1963 | Harwood | 154/46 |
| 3,081,500 | 3/1963 | Griswold et al. | 19/161 |
| 3,081,512 | 3/1963 | Griswold | 28/72 |
| 3,081,514 | 3/1963 | Griswold | 28/78 |
| 3,081,515 | 3/1963 | Griswold et al. | 28/78 |
| 3,491,802 | 1/1970 | Mortensen et al. | 139/420 |
| 3,681,182 | 8/1972 | Kalwaites | 161/109 |
| 3,681,183 | 8/1972 | Kalwaites | 161/109 |
| 3,681,184 | 8/1972 | Kalwaites | 428/288 |
| 3,881,987 | 5/1975 | Benz | 162/116 |
| 4,191,609 | 3/1980 | Trokhan | 162/113 |
| 4,840,829 | 6/1989 | Suzuki et al. | 428/131 |
| 5,245,025 | 9/1993 | Trokhan et al. | 536/56 |

FOREIGN PATENT DOCUMENTS

91/02642 3/1991 WIPO .

OTHER PUBLICATIONS

Veratec Sales Presentation by Zoltan Mate, May 8, 1991—Wet Laid Hydroentangled Formation.

U.S. patent application Ser. No. 07/722,792 filed Jun. 28, 1991 by Trokhan et al.

U.A. patent application Ser. No. 07/724,551 filed Jun. 28, 1991 by Phan et al.

*Primary Examiner*—Sharon Gibson
*Assistant Examiner*—Kathryne Shelborne
*Attorney, Agent, or Firm*—Larry L. Huston; E. Kelly Linman; Jacobus C. Rasser

[57] ABSTRACT

A cellulosic fibrous structure having two regions distinguished from one another by basis weight. The first region is an essentially continuous high basis weight network. The second region comprises a plurality of discrete low basis weight regions. The cellulosic fibers forming the plurality of second regions are generally radially oriented within each region. The cellulosic fibrous structure may be formed by a forming belt having zones of different flow resistances arranged in a particular ratio of flow resistances. The zones of different flow resistances provide for selectively draining a liquid carrier through the different zones of the belt in a radial flow pattern.

7 Claims, 21 Drawing Sheets

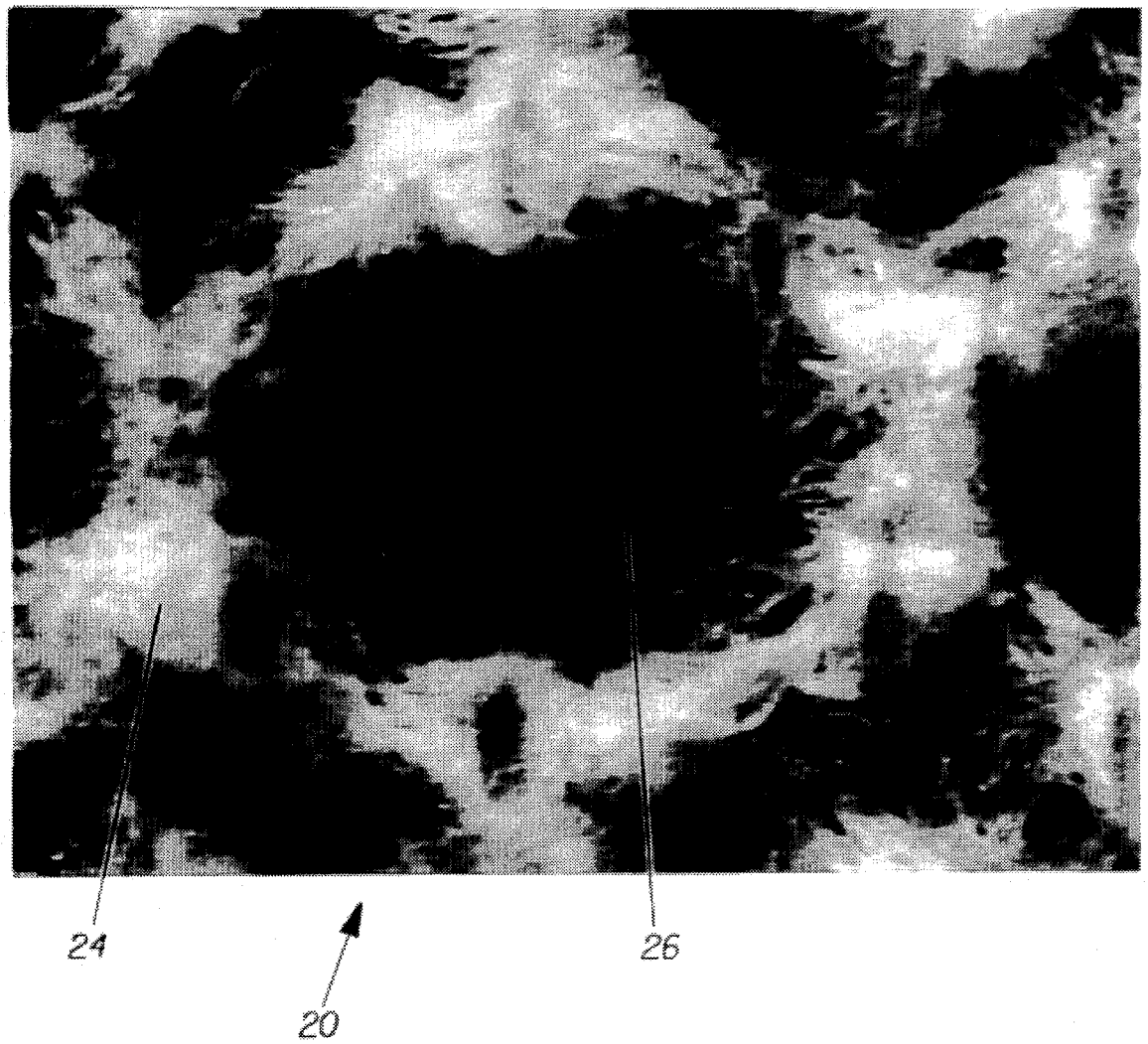
Fig. 2A$_1$

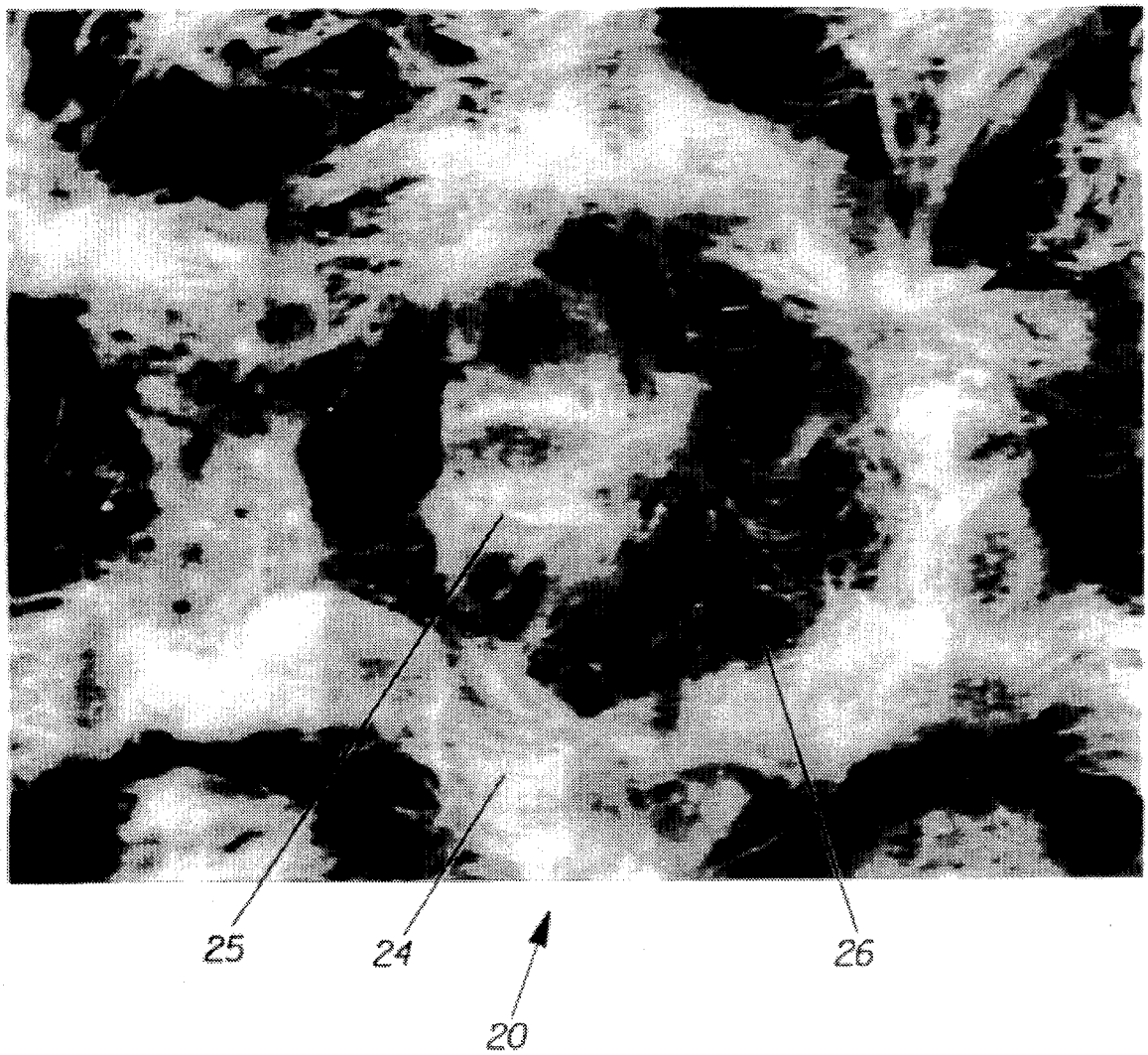
Fig.2A2

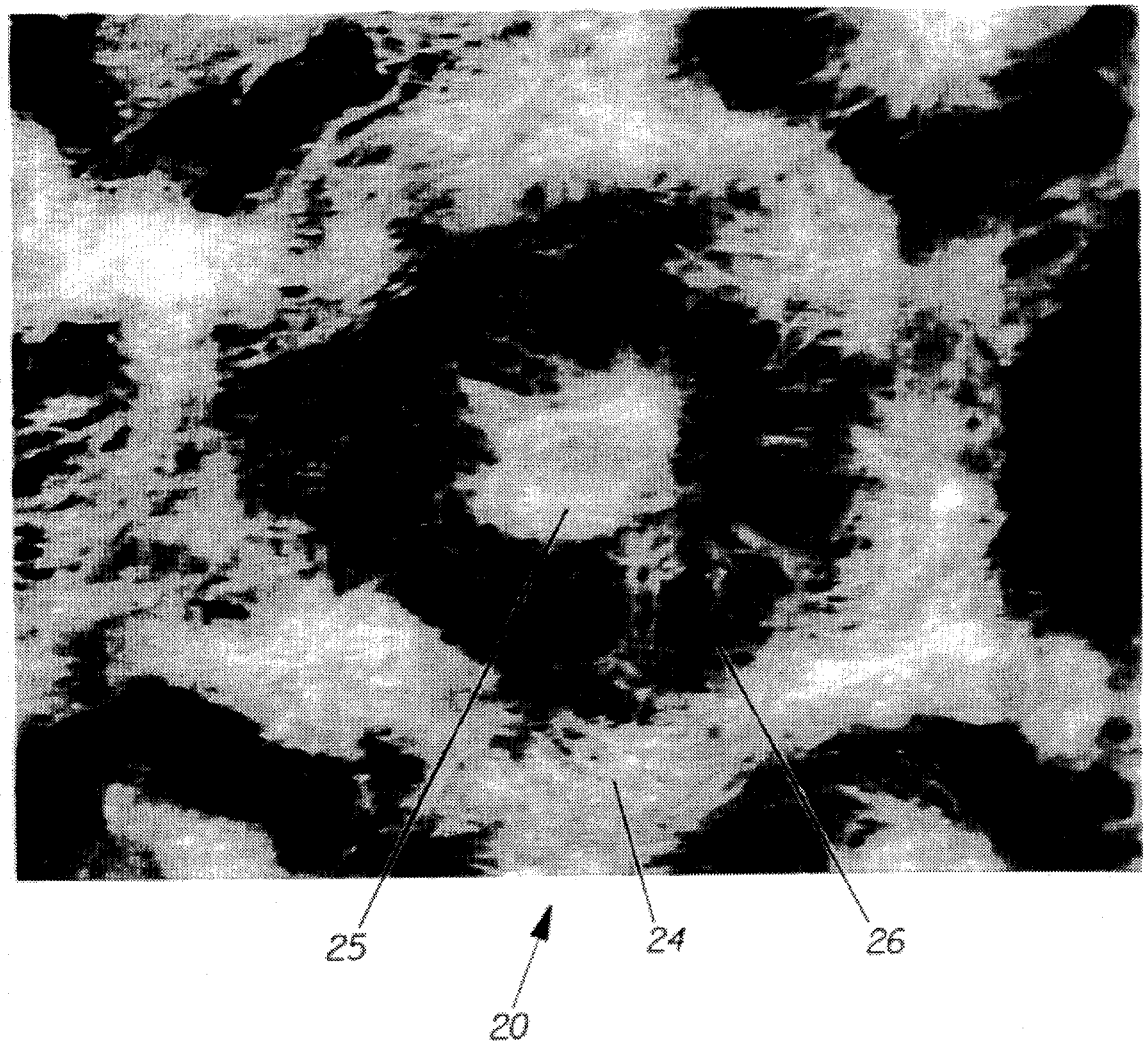
Fig. 2A3

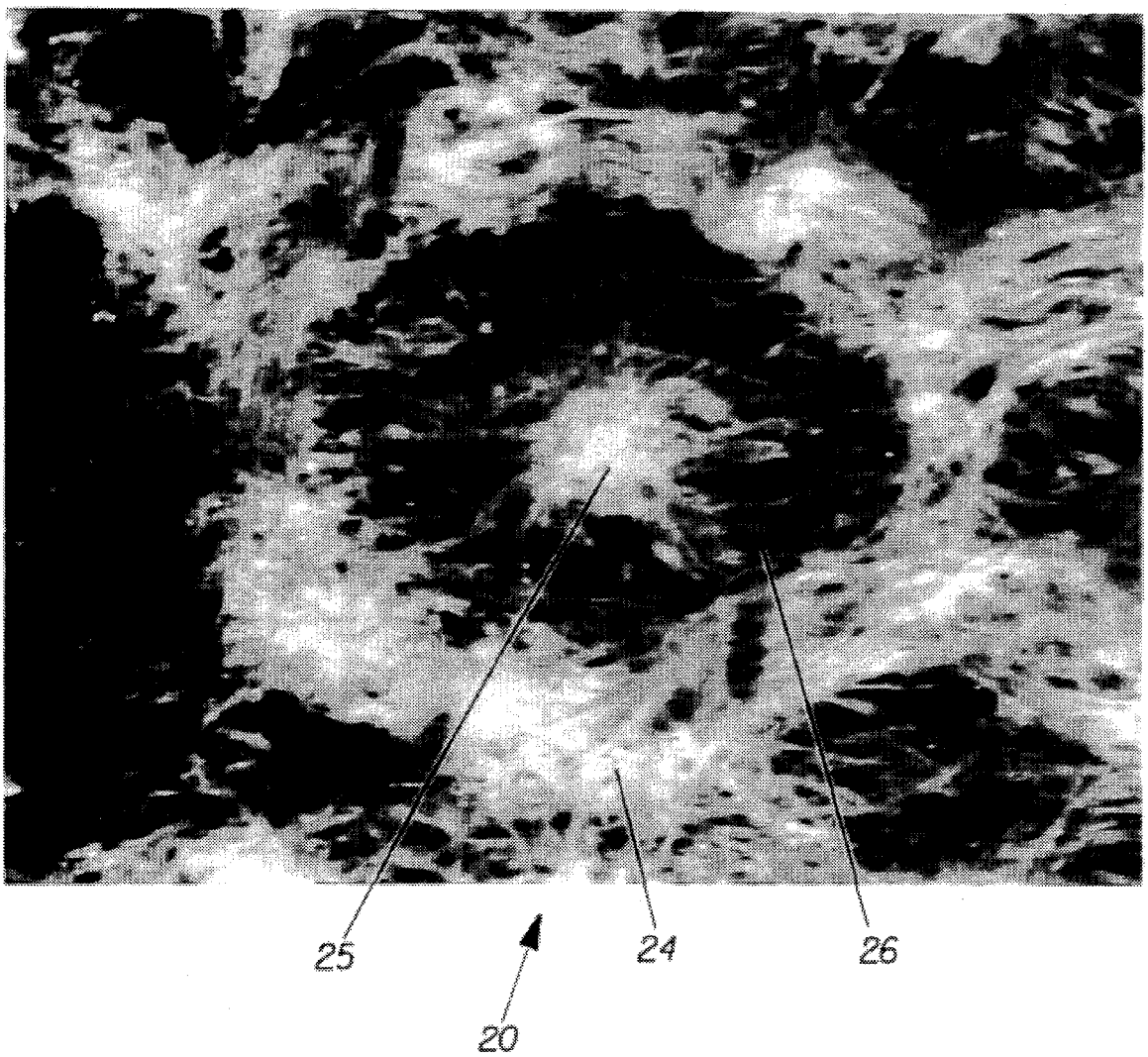
Fig. 2B1

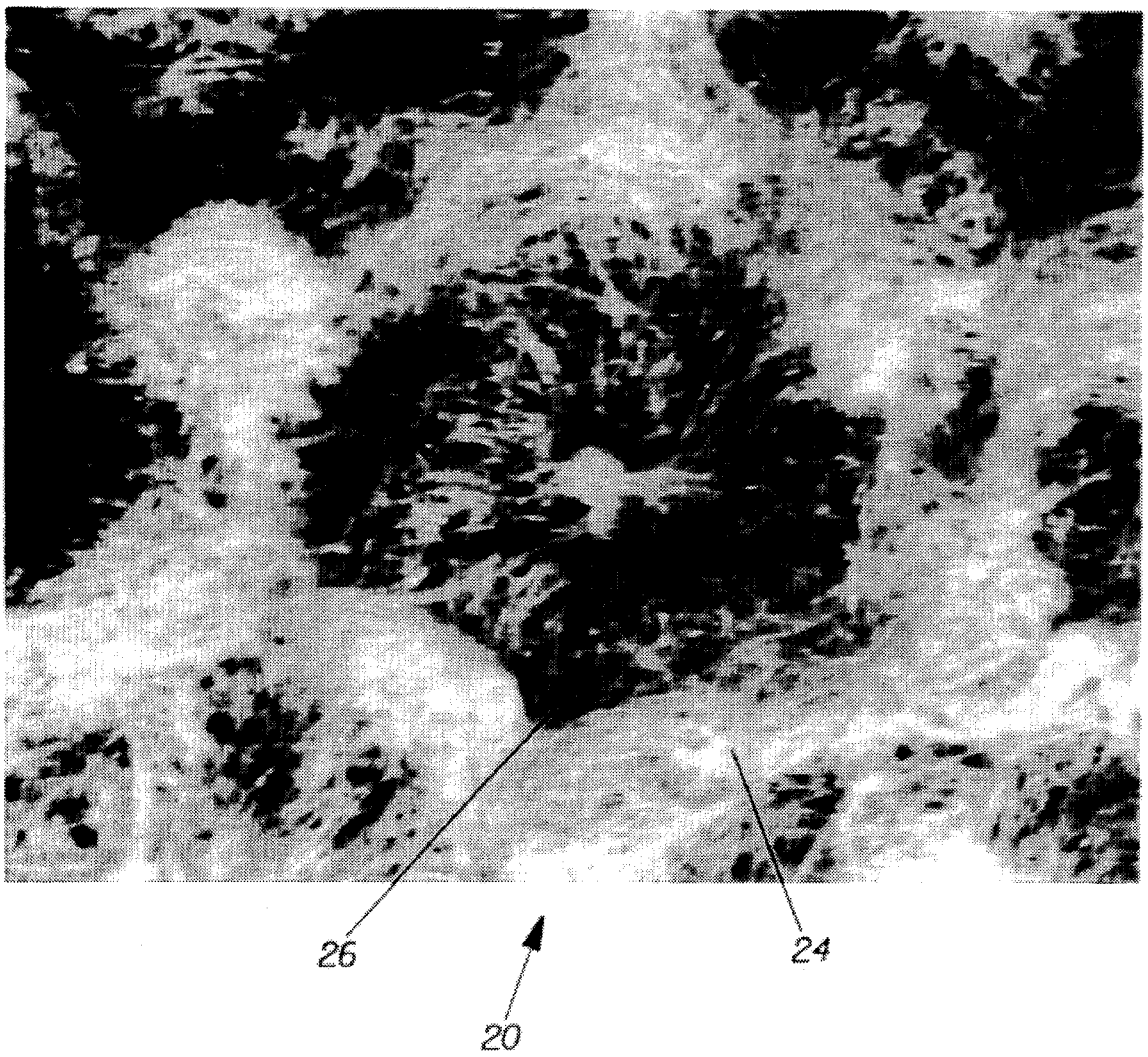
Fig. 2C1

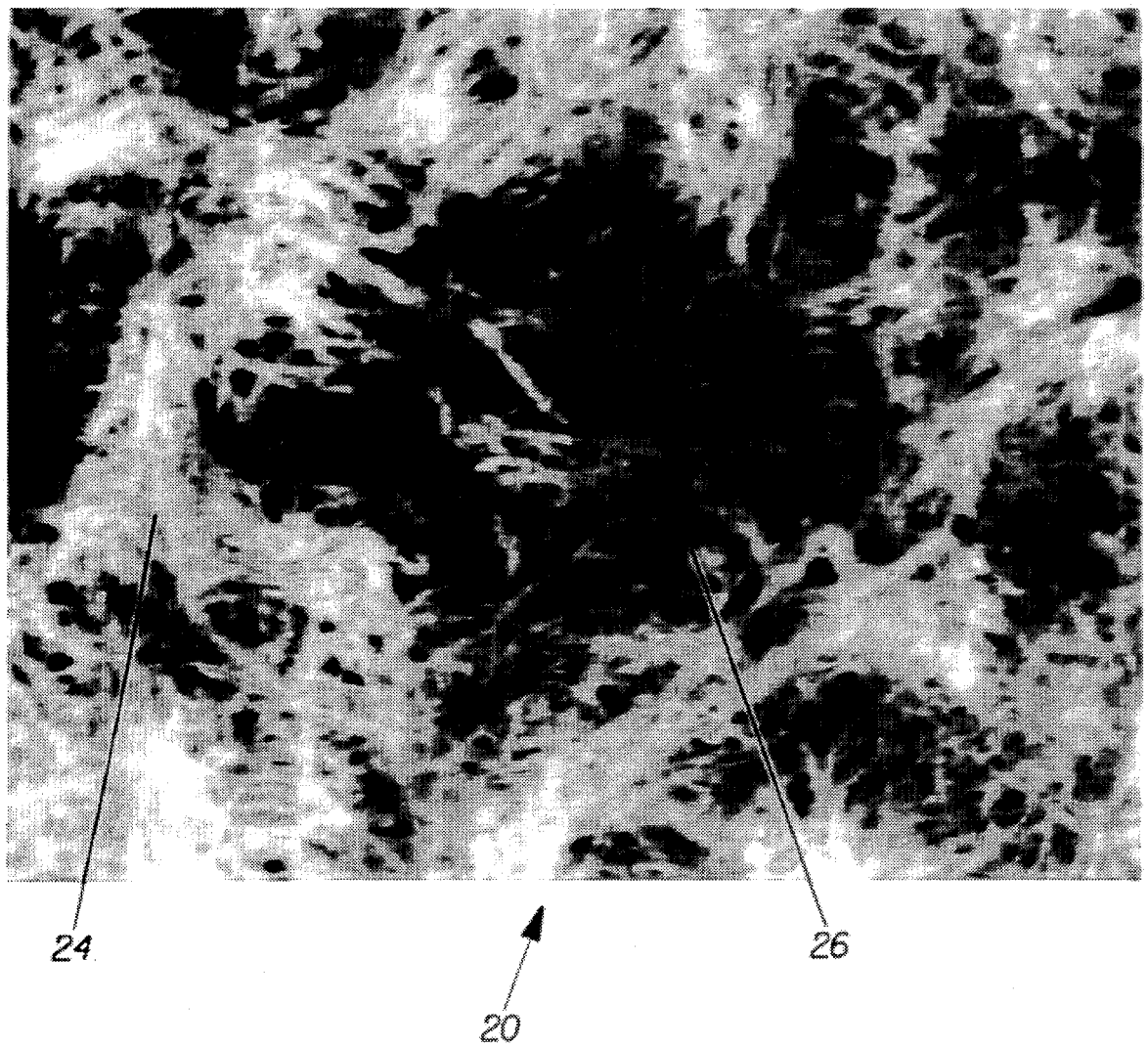
Fig. 2D1

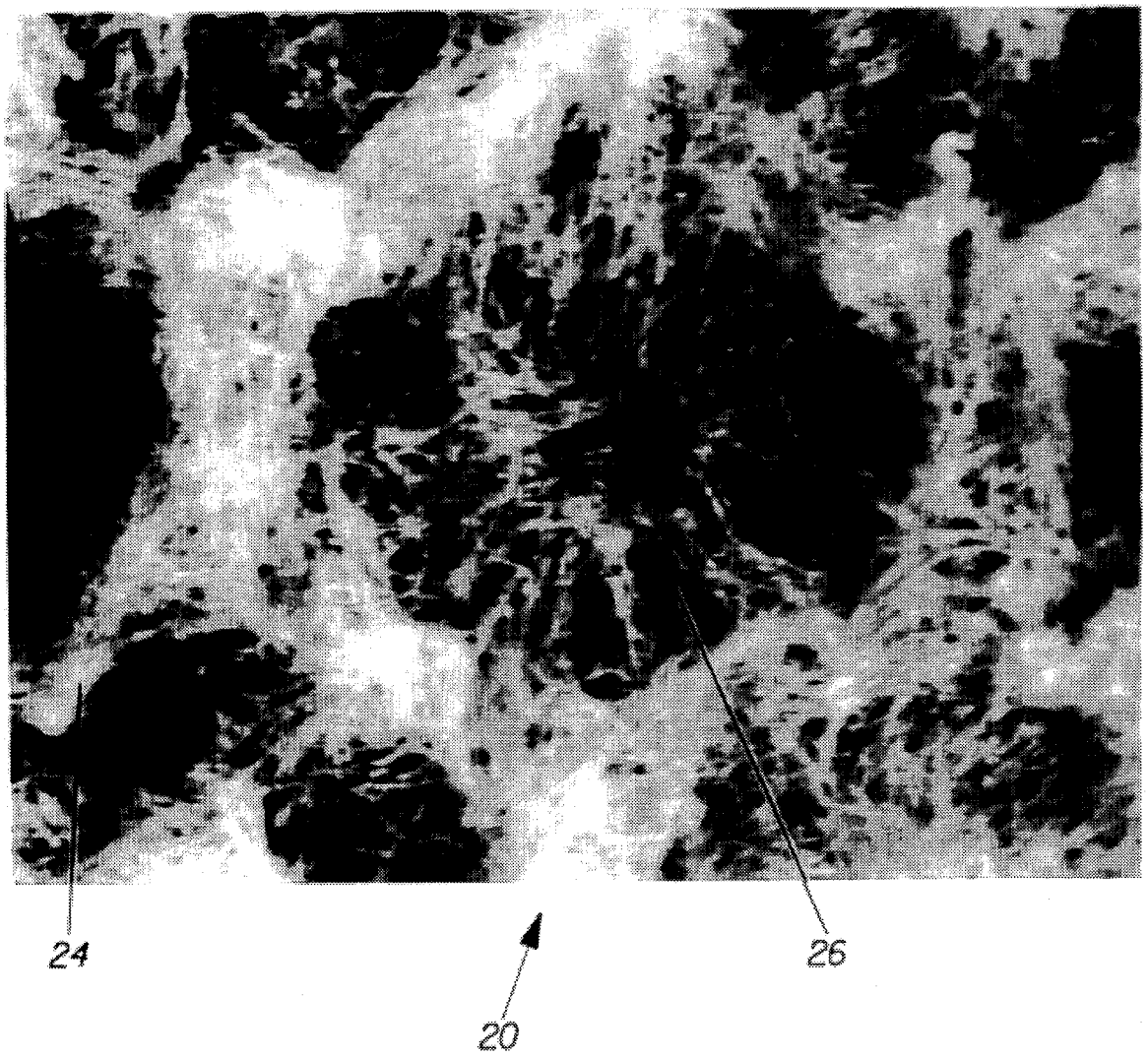
Fig. $2D_2$

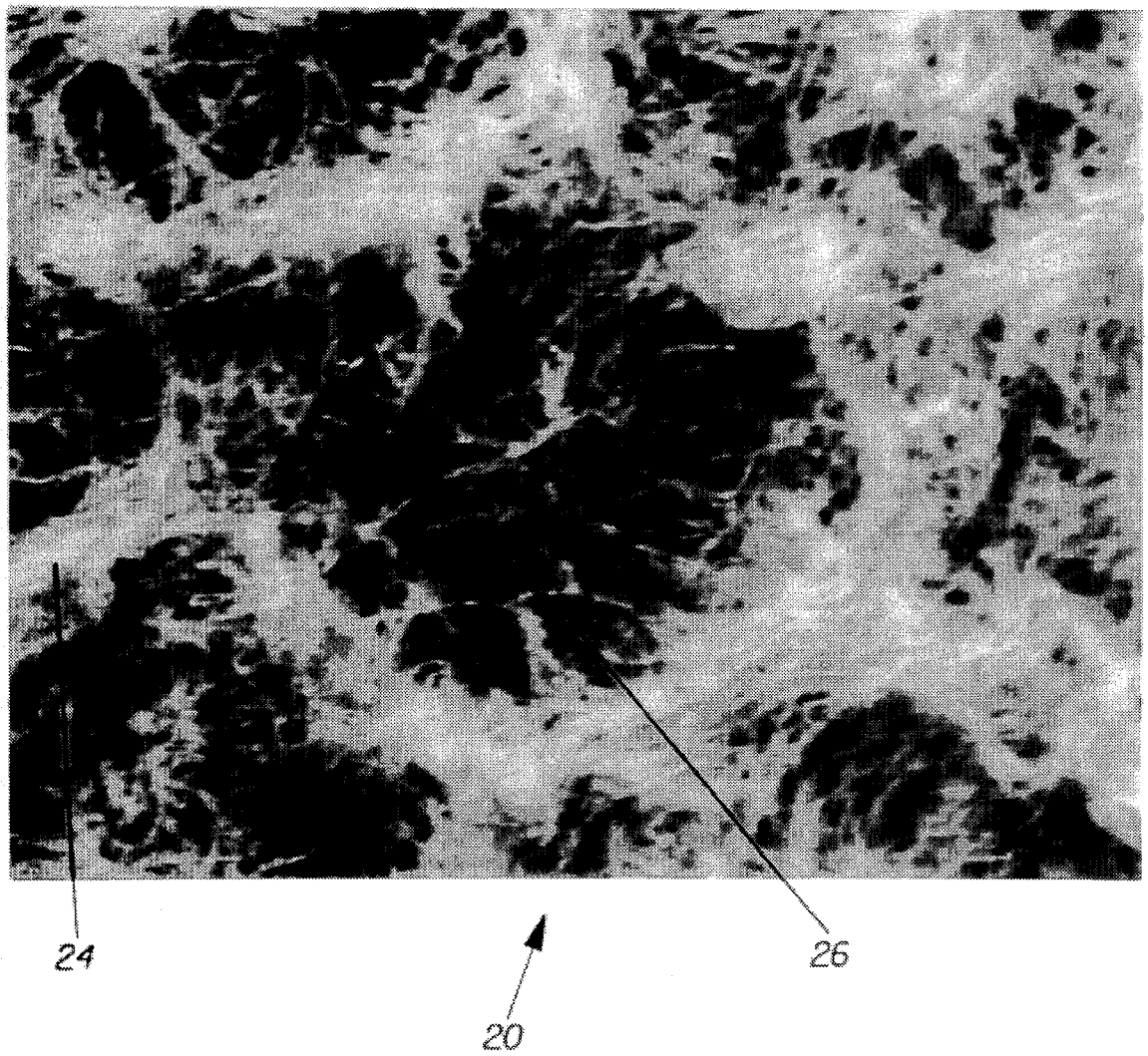
Fig. 2D3

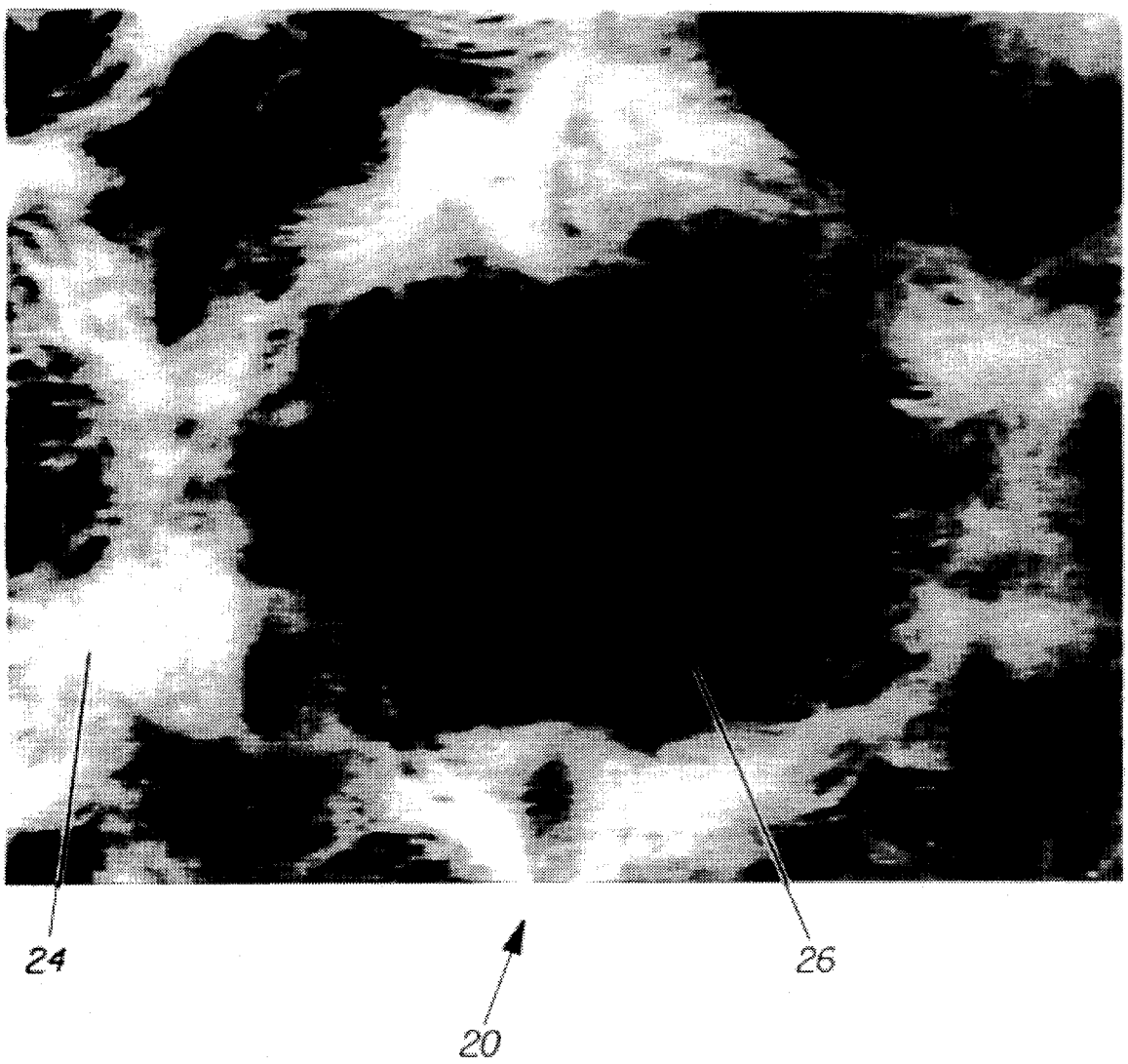
Fig. 3A1

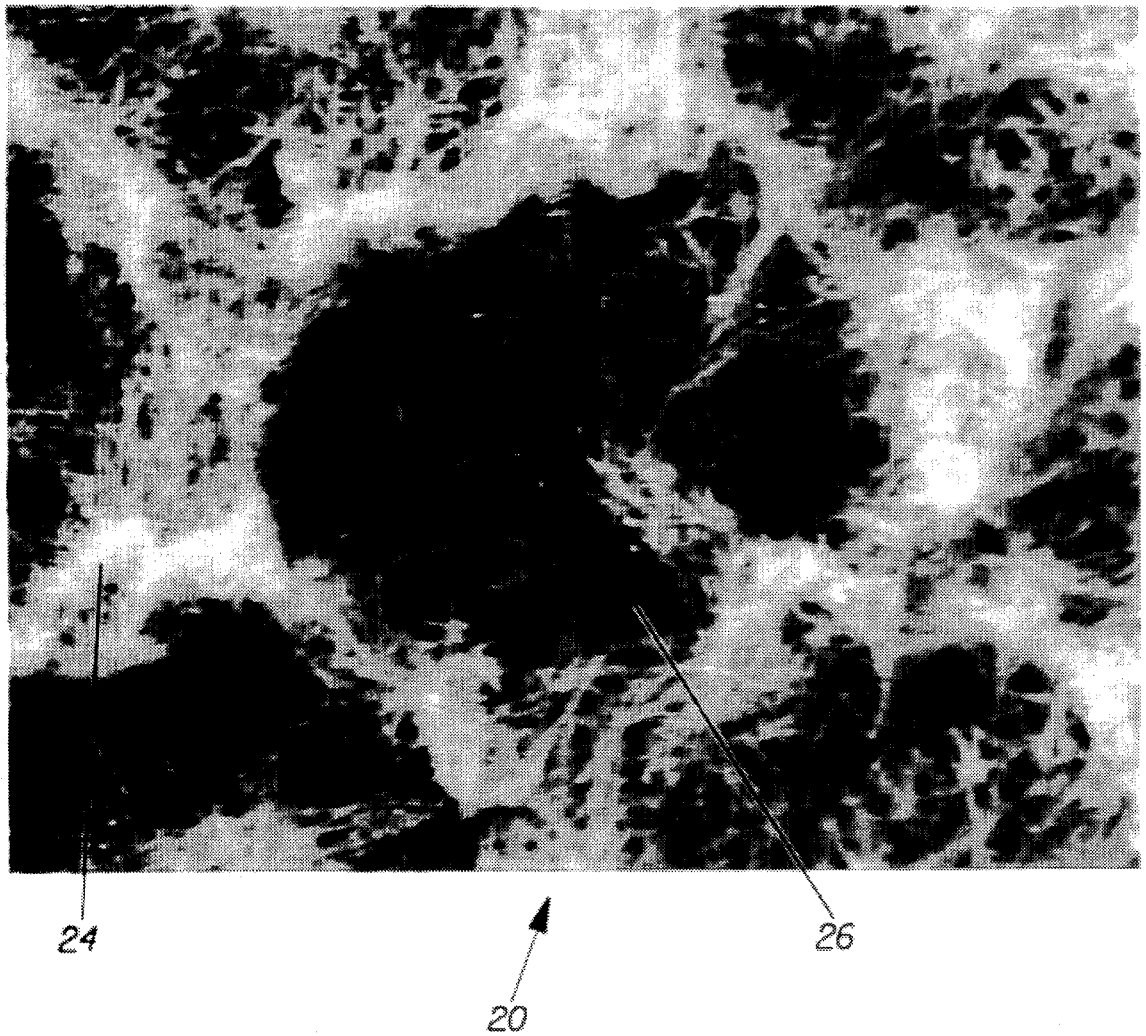
Fig. 3A2

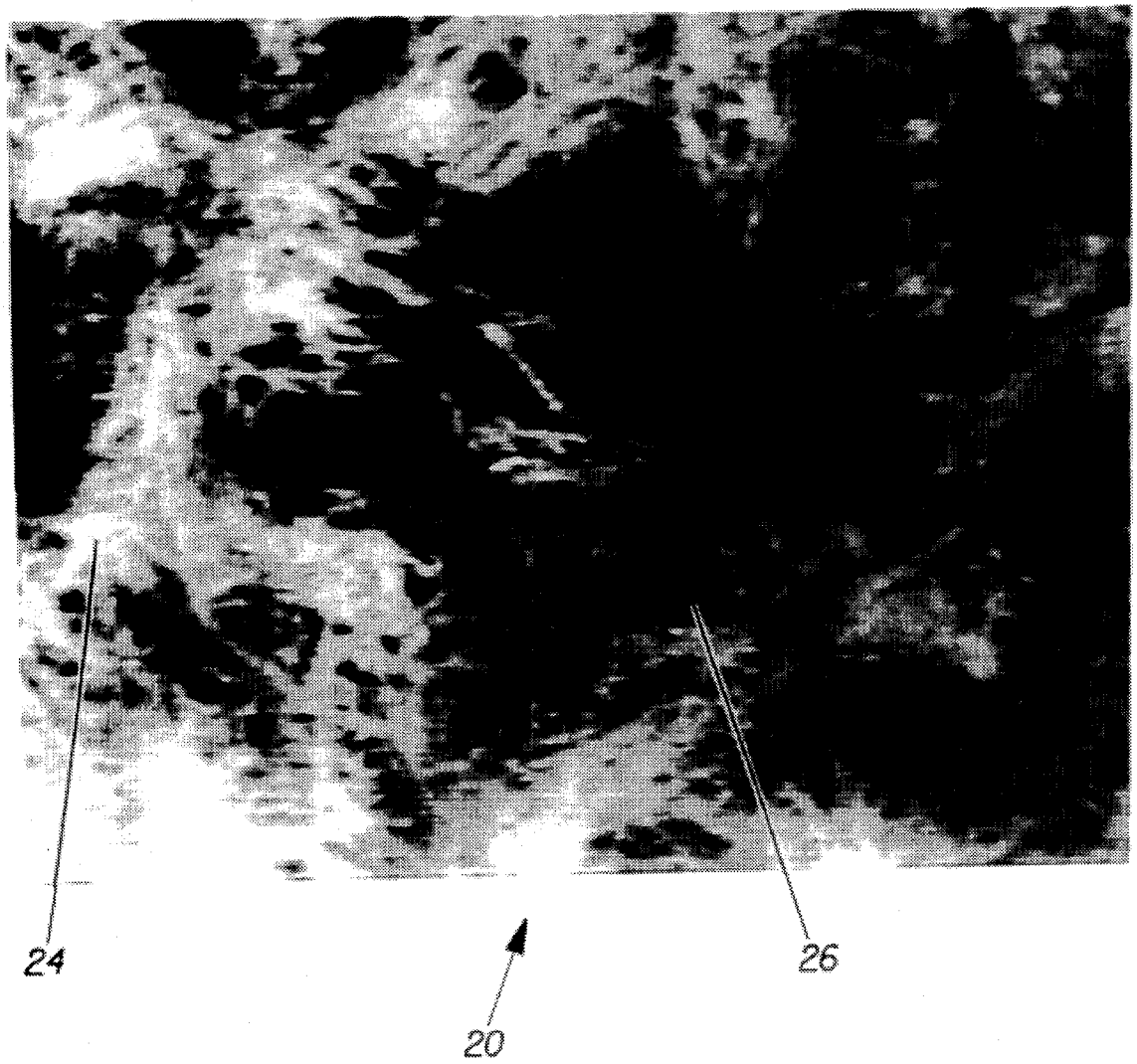
Fig. 3A3

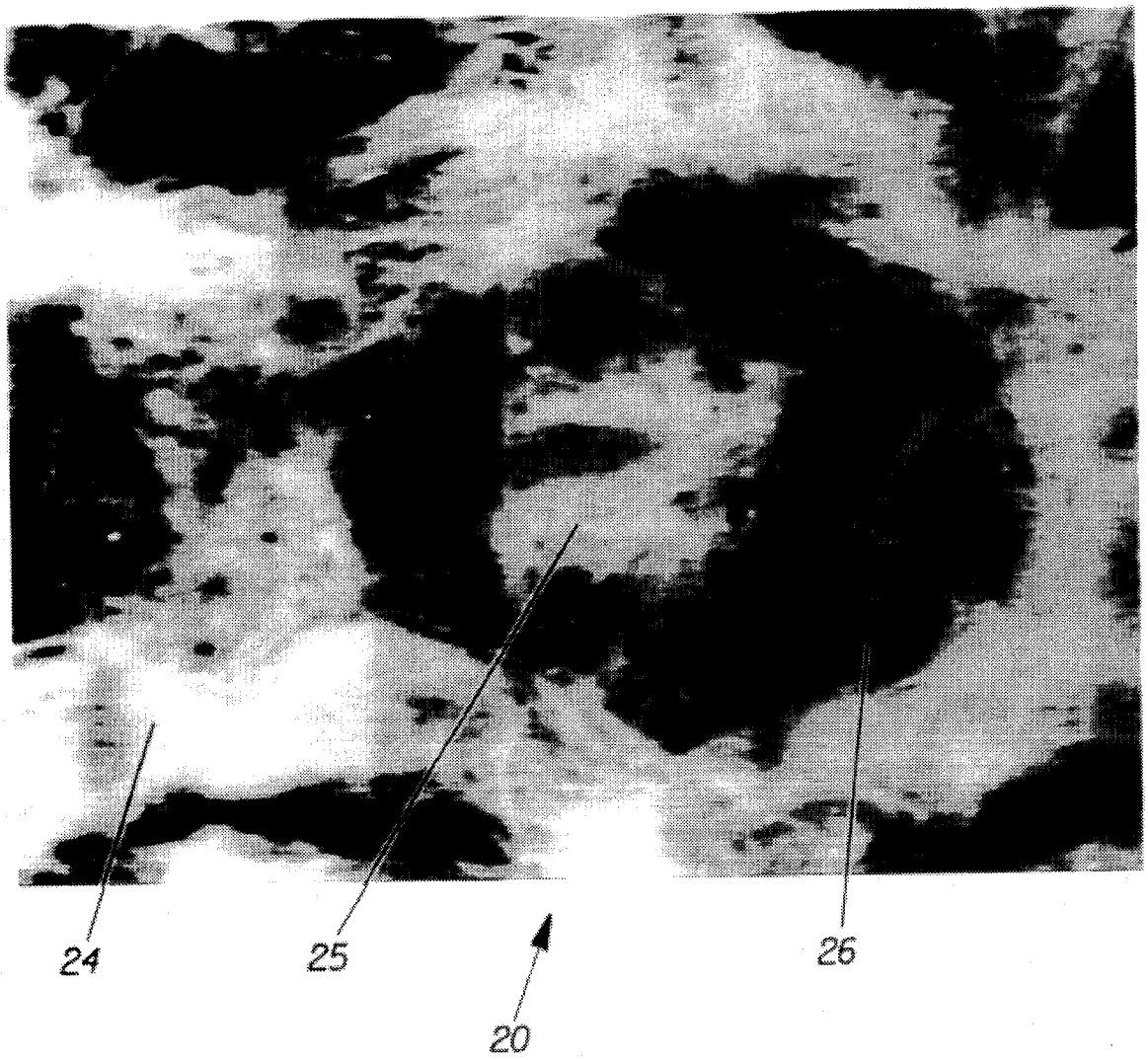
Fig. 3B1

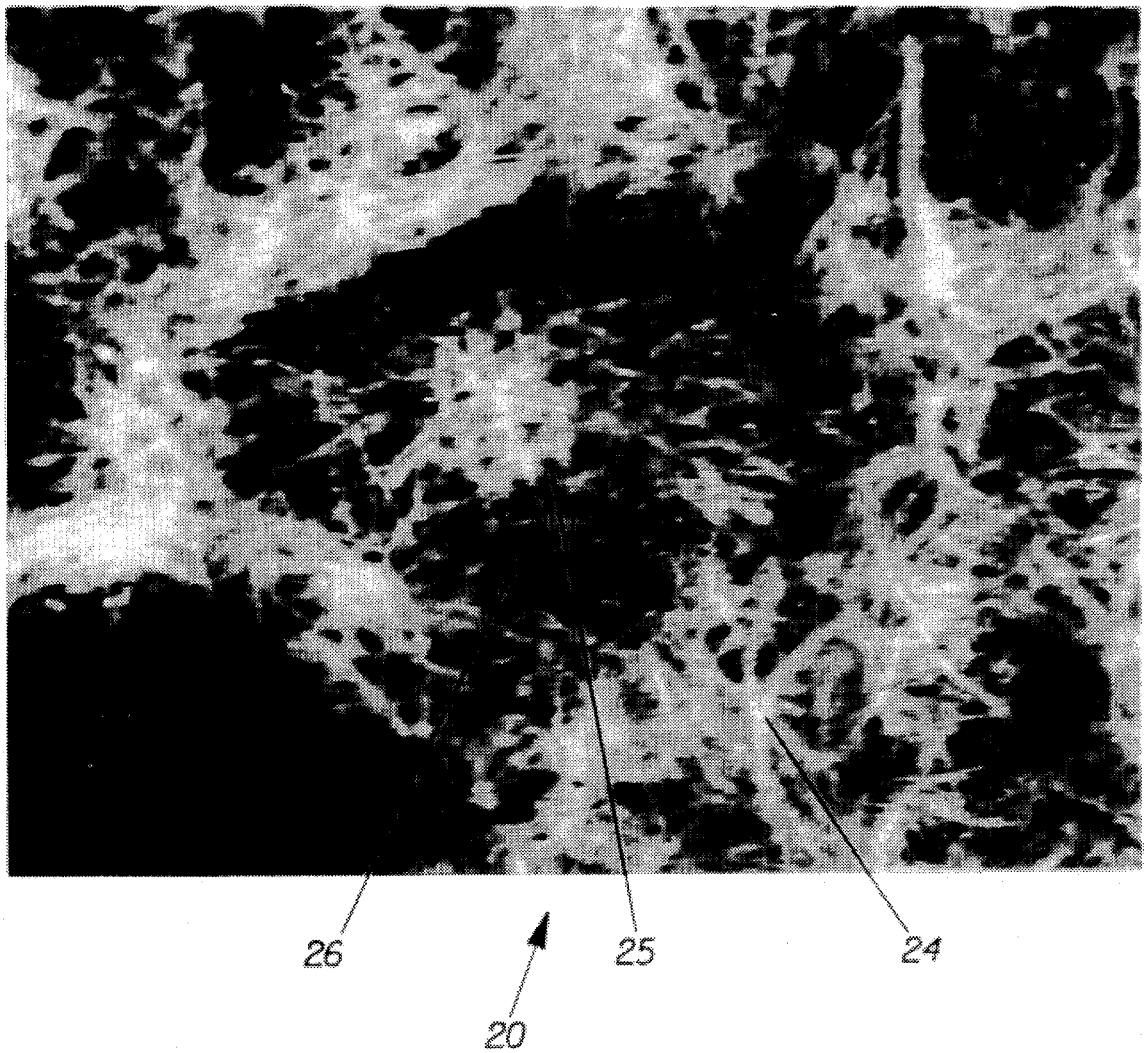
Fig. 3B2

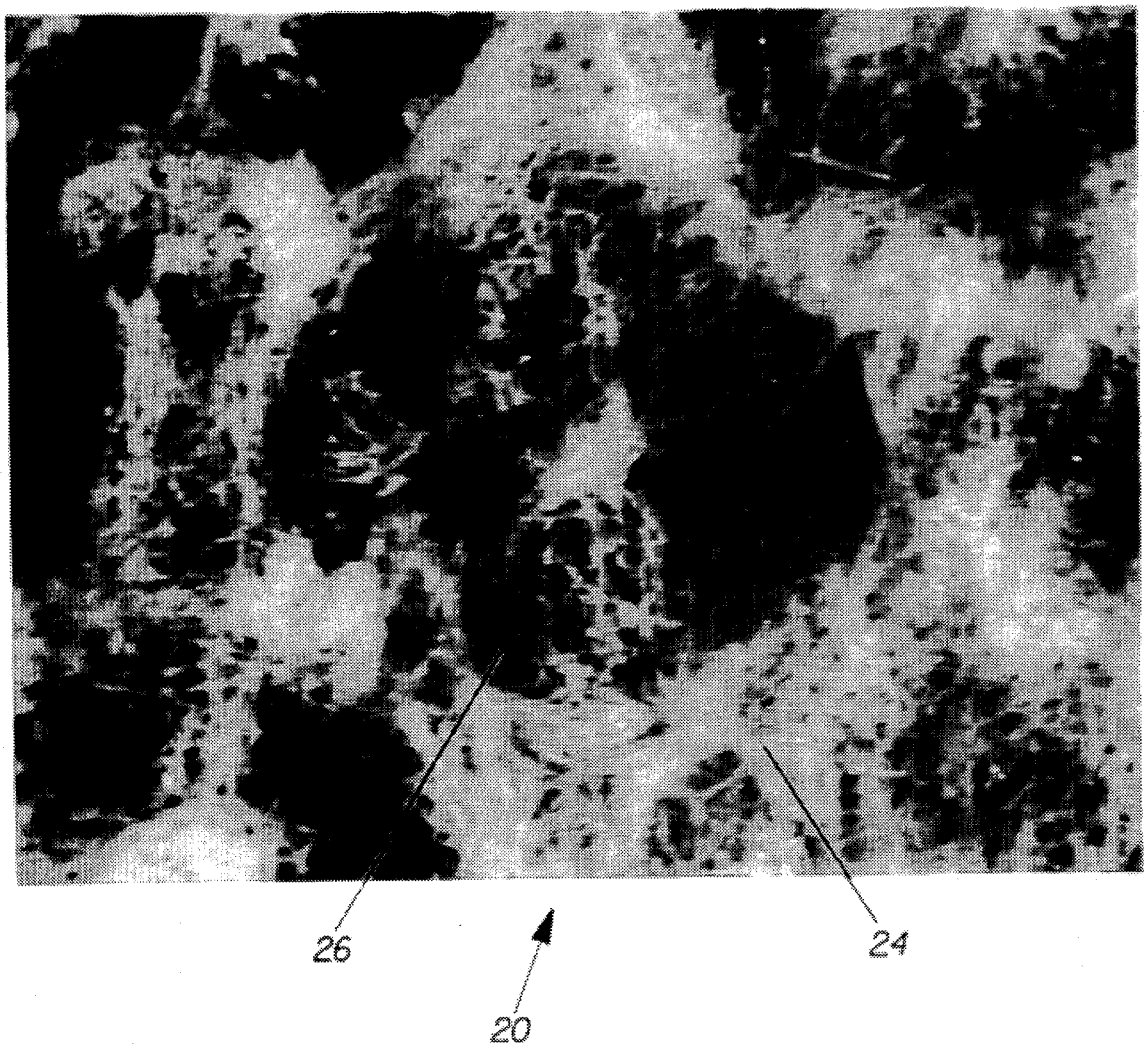
Fig. 3C1

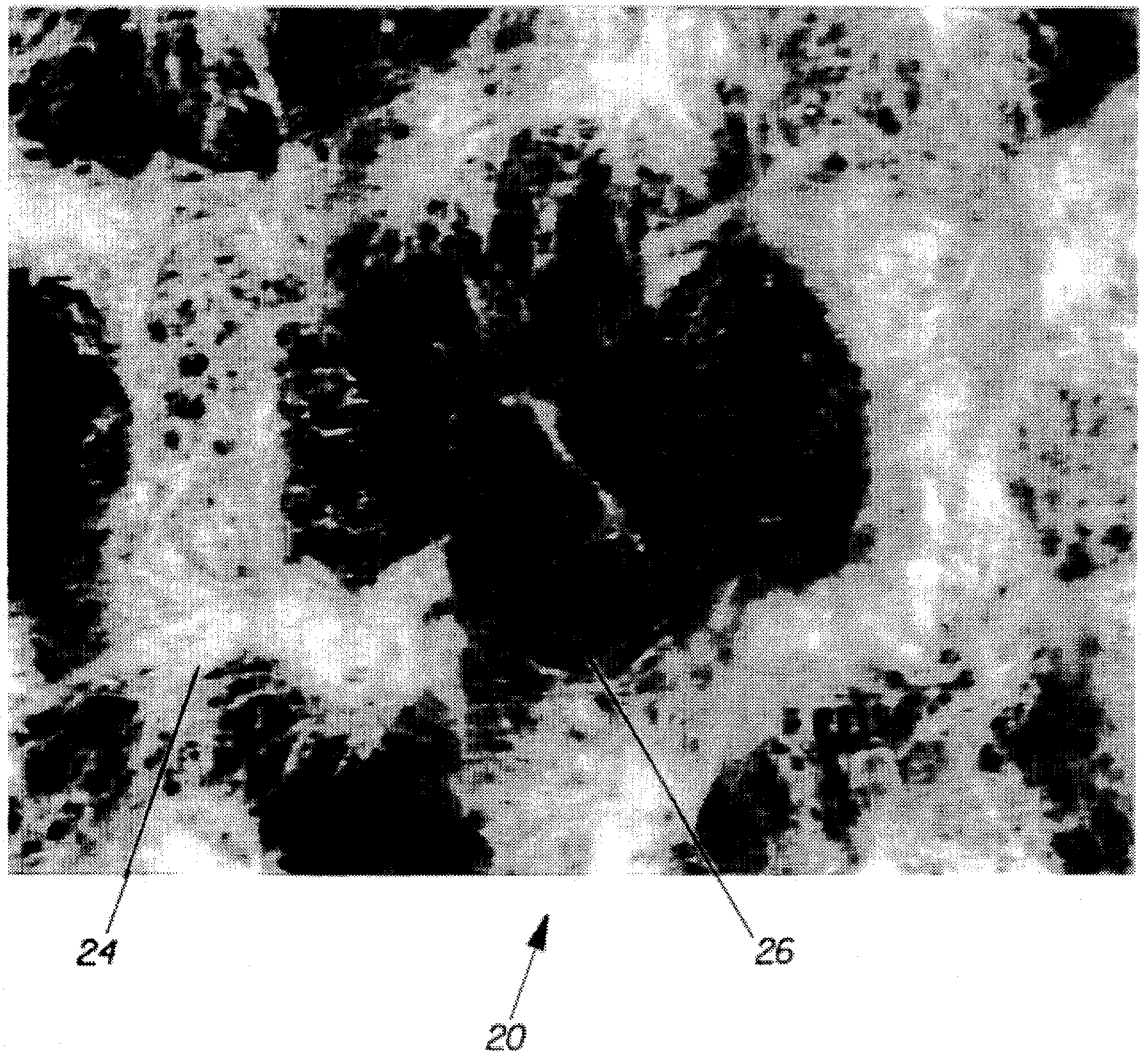
Fig. $3C_2$

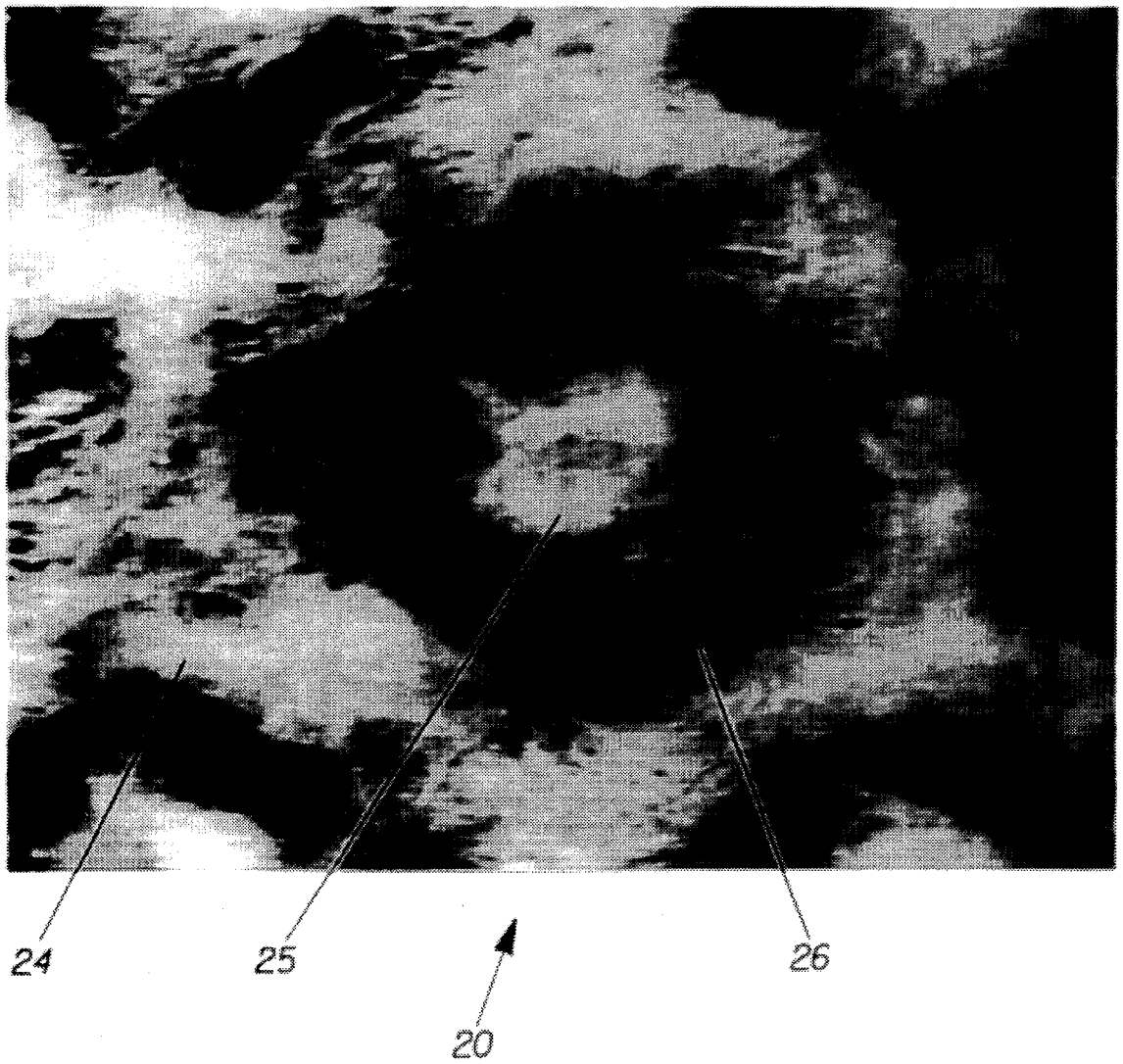
Fig. 3D1

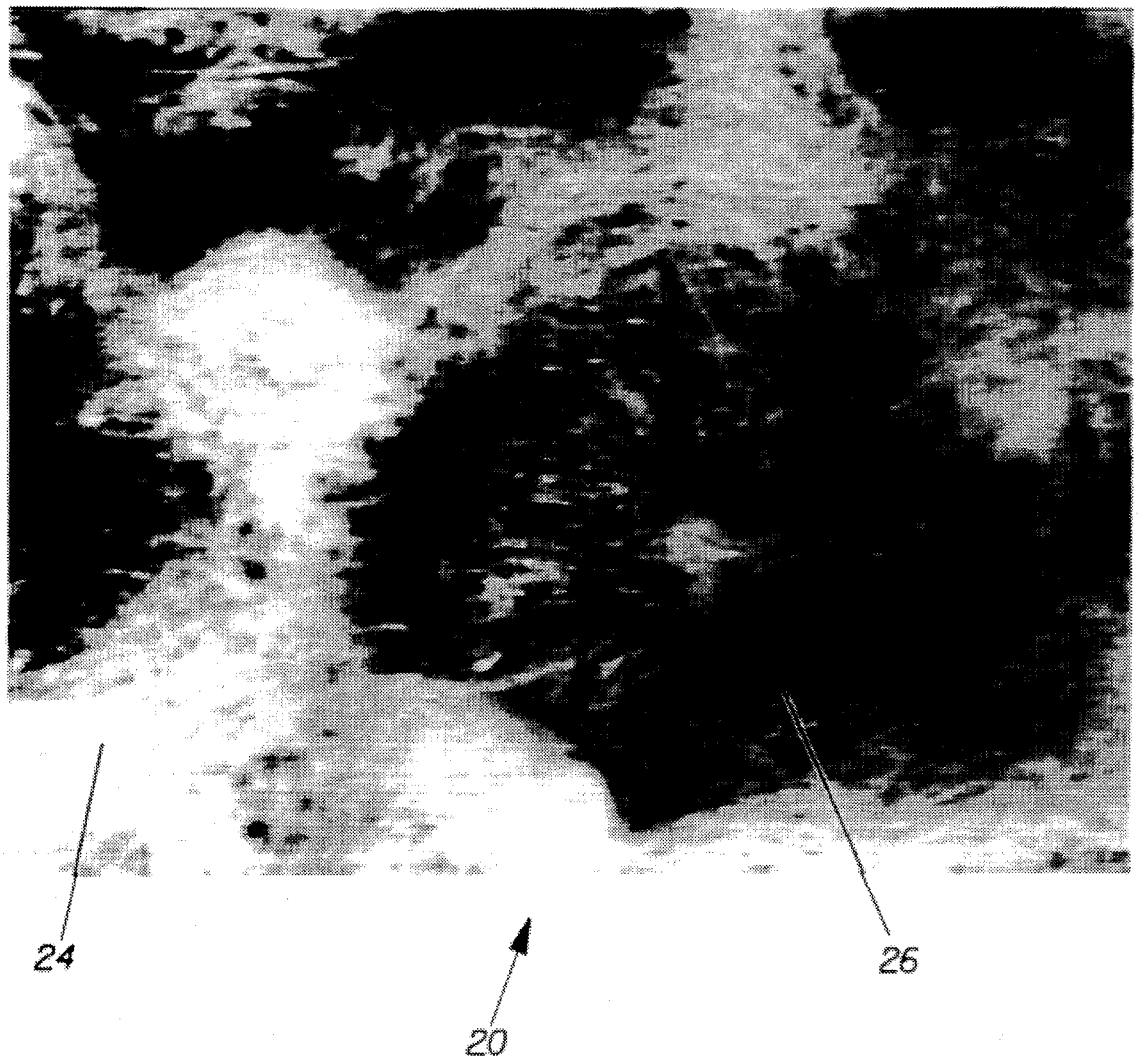
Fig. $3D_2$

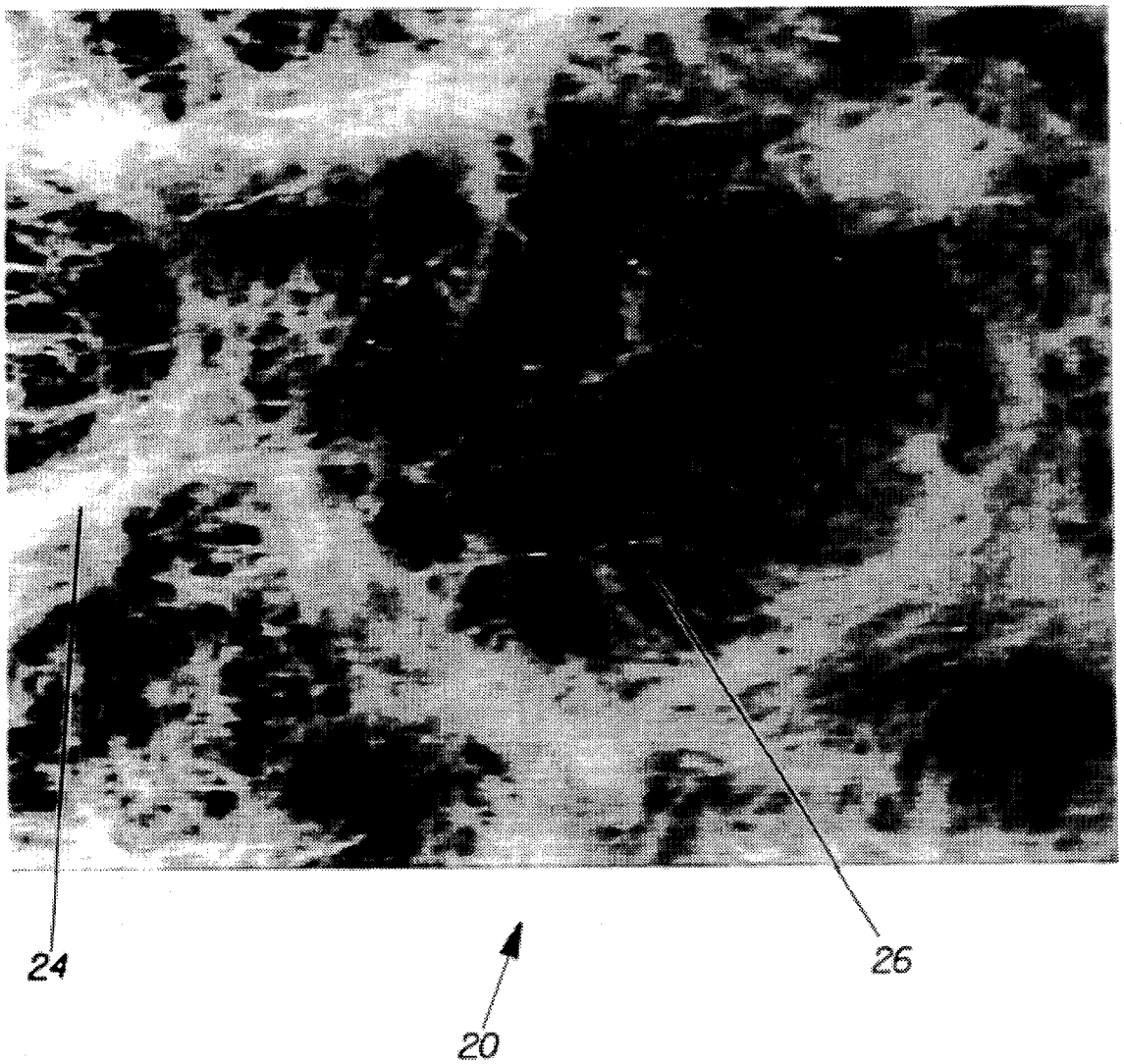
Fig. 3D3

CELLULOSIC FIBROUS STRUCTURES HAVING DISCRETE REGIONS WITH RADIALLY ORIENTED FIBERS THEREIN, APPARATUS THEREFOR AND PROCESS OF MAKING

This is a continuation of application Ser. No. 07/922,436, filed on Jul. 29, 1992, now abandoned.

FIELD OF THE INVENTION

This invention relates to cellulosic fibrous structures having plural regions discriminated by basis weights. More particularly, this invention relates to cellulosic fibrous structures having an essentially continuous high basis weight region and discrete low basis weight regions which comprise radially oriented fibers. The cellulosic fibrous structures are suitable for use in consumer products.

BACKGROUND OF THE INVENTION

Cellulosic fibrous structures, such as paper, are well known in the art. Such fibrous structures are in common use today for paper towels, toilet tissue, facial tissue, etc.

To meet the needs of the consumer, these cellulosic fibrous structures must balance several competing interests. For example, the cellulosic fibrous structure must have sufficient tensile strength to prevent the cellulosic fibrous structure from tearing or shredding during ordinary use or when relatively small tensile forces are applied. The cellulosic fibrous structure must also be absorbent, so that liquids may be quickly absorbed and fully retained by the cellulosic fibrous structure. The cellulosic fibrous structure should also exhibit sufficient softness, so that it is tactilely pleasant and not harsh during use. The cellulosic fibrous structure should exhibit a high degree of opacity, so that it does not appear flimsy or of low quality to the user. Against this backdrop of competing interests, the cellulosic fibrous structure must be economical, so that it can be manufactured and sold for a profit, and yet is still affordable to the consumer.

Tensile strength, one of the aforementioned properties, is the ability of the cellulosic fibrous structure to retain its physical integrity during use. Tensile strength is controlled by the weakest link under tension in the cellulosic fibrous structure. The cellulosic fibrous structure will exhibit no greater tensile strength than that of any region in the cellulosic fibrous structure which is undergoing a tensile loading, as the cellulosic fibrous structure will fracture or tear through such weakest region.

The tensile strength of a cellulosic fibrous structure may be improved by increasing the basis weight of the cellulosic fibrous structure. However, increasing the basis weight requires more cellulosic fibers to be utilized in the manufacture, leading to greater expense for the consumer and requiring greater utilization of natural resources for the raw materials.

Absorbency is the property of the cellulosic fibrous structure which allows it to attract and retain contacted fluids. Both the absolute quantity of fluid retained and the rate at which the cellulosic fibrous structure absorbs contacted fluids must be considered with respect to the desired end use of the cellulosic fibrous structure. Absorbency is influenced by the density of the cellulosic fibrous structure. If the cellulosic fibrous structure is too dense, the interstices between fibers may be too small and the rate of absorption may not be great enough for the intended use. If the interstices are too large, capillary attraction of contacted fluids is minimized and, due to surface tension limitations, fluids will not be retained by the cellulosic fibrous structure.

Softness is the ability of a cellulosic fibrous structure to impart a particularly desirable tactile sensation to the user's skin. Softness is influenced by bulk modulus (fiber flexibility, fiber morphology, bond density and unsupported fiber length), surface texture (crepe frequency, size of various regions and smoothness), and the stick-slip surface coefficient of friction. Softness is inversely proportional to the ability of the cellulosic fibrous structure to resist deformation in a direction normal to the plane of the cellulosic fibrous structure.

Opacity is the property of a cellulosic fibrous structure which prevents or reduces light transmission therethrough. Opacity is directly related to the basis weight, density and uniformity of fiber distribution of the cellulosic fibrous structure. A cellulosic fibrous structure having relatively greater basis weight or uniformity of fiber distribution will also have greater opacity for a given density. Increasing density will increase opacity to a point, beyond which further densification will decrease opacity.

One compromise between the various aforementioned properties is to provide a cellulosic fibrous structure having mutually discrete zero basis weight apertures in an essentially continuous network having a particular basis weight. The discrete apertures represent regions of lower basis weight than the essentially continuous network, providing for bending perpendicular to the plane of the cellulosic fibrous structure, and hence increase the flexibility of the cellulosic fibrous structure. The apertures are circumscribed by the continuous network, which has a desired basis weight and which controls the tensile strength of the cellulosic fibrous structure.

Such apertured cellulosic fibrous structures are known in the prior art. For example, U.S. Pat. No. 3,034,180 issued May 15, 1962 to Greiner et al. discloses cellulosic fibrous structures having bilaterally staggered apertures and aligned apertures. Moreover, cellulosic fibrous structures having various shapes of apertures are disclosed in the prior art. For example, Greiner et al. discloses square apertures, diamond-shaped apertures, round apertures and cross-shaped apertures.

However, apertured cellulosic fibrous structures have several shortcomings. The apertures represent transparencies in the cellulosic fibrous structure and may cause the consumer to feel the structure is of lesser quality or strength than desired. The apertures are generally too large to absorb and retain any fluids, due to the limited surface tension of fluids typically encountered by the aforementioned tissue and towel products. Also, the basis weight of the network around the apertures must be increased so that sufficient tensile strength is obtained.

In addition to the zero basis weight apertured degenerate case, attempts have been made to provide a cellulosic fibrous structure having mutually discrete nonzero low basis weight regions in an essentially continuous network. For example, U.S. Pat. No. 4,514,345 issued Apr. 30, 1985 to Johnson et al. discloses a cellulosic fibrous structure having discrete nonzero low basis weight hexagonally shaped regions. A similarly shaped pattern, utilized in a textile fabric, is disclosed in U.S. Pat. No. 4,144,370 issued Mar. 13, 1979 to Boulton.

The nonapertured cellulosic fibrous structures disclosed in these references provide the advantages of slightly increased opacity and the presence of some absorbency in the discrete low basis weight regions, but do not solve the problem that very little tensile load is carried by the discrete nonzero low basis weight regions, thus limiting the overall burst strength of the cellulosic fibrous structure. Also, neither Johnson et al. nor Boulton teach cellulosic fibrous structures having relatively high opacity in the discrete low basis weight regions.

Plural basis weight cellulosic fibrous structures are typically manufactured by depositing a liquid carrier having the cellulosic fibers homogeneously entrained therein onto an apparatus having a fiber retentive liquid pervious forming element. The forming element may be generally planar and is typically an endless belt.

The aforementioned references, and additional teachings such as U.S. Pat. Nos. 3,322,617 issued May 30, 1967 to Osborne; 3,025,585 issued Mar. 20, 1962 to Griswold, and 3,159,530 issued Dec. 1, 1964 to Heller et al. disclose various apparatuses suitable for manufacturing cellulosic fibrous structures having discrete low basis weight regions. The discrete low basis weight regions according to these teachings are produced by a pattern of upstanding protuberances joined to the forming element of the apparatus used to manufacture the cellulosic fibrous structure. However, in each of the aforementioned references, the upstanding protuberances are disposed in a regular, repeating pattern. The pattern may comprise protuberances staggered relative to the adjacent protuberances or aligned with the adjacent protuberances. Each protuberance (whether aligned, or staggered) is generally equally spaced from the adjacent protuberances. Indeed, Heller et al. utilizes a woven Fourdrinier wire for the protuberances.

The arrangement of equally spaced protuberances represents another shortcoming in the prior art. The apparatuses having this arrangement provide substantially uniform and equal flow resistances (and hence drainage and hence deposition of cellulosic fibers) throughout the entire liquid pervious portion of the forming element utilized to make the cellulosic fibrous structure. Substantially equal quantities of cellulosic fibers are deposited in the liquid pervious region because equal flow resistances to the drainage of the liquid carrier are present in the spaces between adjacent protuberances. Thus, fibers may be relatively homogeneously and uniformly deposited, although not necessarily randomly or uniformly aligned, in each region of the apparatus and will form a cellulosic fibrous structure having a like distribution and alignment of fibers.

One teaching in the prior art not to have each protuberance equally spaced from the adjacent protuberances is disclosed in U.S. Pat. No. 795,719 issued Jul. 25, 1905 to Motz. However, Motz discloses protuberances disposed in a generally random pattern which does not advantageously distribute the cellulosic fibers in a manner to consciously influence any one of or optimize a majority of the aforementioned properties.

Accordingly, it is an object of this invention to overcome the problems of the prior art and particularly to overcome the problems presented by the competing interests of maintaining high tensile strength, high absorbency, high softness, and high opacity without unduly sacrificing any of the other properties or requiring an uneconomical or undue use of natural resources. Specifically, it is an object of this invention to provide a method and apparatus for producing a cellulosic fibrous structure, such as paper, by having relatively high and relatively low flow resistances to the drainage of the liquid carrier of the fibers in the apparatus and to proportion such flow resistances, relative to each other, to advantageously radially arrange the fibers in the low basis weight regions.

By having regions of relatively high and relatively low resistances to flow present in the apparatus, one can achieve greater control over the orientation and pattern of deposition of the cellulosic fibers, and obtain cellulosic fibrous structures not heretofore known in the art. Generally, there is an inverse relation between the flow resistance of a particular region of the liquid pervious fiber retentive forming element and the basis weight of the region of the resulting cellulosic fibrous structure corresponding to such regions of the forming element. Thus, regions of relatively low flow resistance will produce corresponding regions in the cellulosic fibrous structure having a relatively high basis weight and vice versa, provided, of course, the fibers are retained on the forming element.

More particularly, the regions of relatively low flow resistance should be continuous so that a continuous high basis weight network of fibers results, and tensile strength is not sacrificed. The regions of relatively high flow resistance (which yield relatively low basis weight regions in the cellulosic fibrous structure and which orient the fibers) are preferably discrete, but may be continuous.

Additionally, the size and spacing of the protuberances relative to the fiber length should be considered. If the protuberances are too closely spaced, the cellulosic fibers may bridge the protuberances and not be deposited onto the face of the forming element.

According to the present invention, the forming element is a forming belt having a plurality of regions discriminated from one another by having different flow resistances. The liquid carrier drains through the regions of the forming belt according to the flow resistance presented thereby. For example, if there are impervious regions, such as protuberances or blockages in the forming belts, no liquid carrier can drain through these regions and hence few or no fibers will be deposited in such regions.

The ratio of the flow resistances between the regions of high flow resistance and the regions of low flow resistance is thus critical to determining the pattern in which the cellulosic fibers entrained in the liquid carrier will be deposited. Generally, more fibers will be deposited in zones of the forming belt having a relatively lesser flow resistance, because more liquid carrier may drain through such regions. However, it is to be recognized that the flow resistance of a particular region on the forming belt is not constant and will change as a function of time.

By properly selecting the ratio of the flow resistance between discrete areas having high flow resistance and continuous areas of lower flow resistance, a cellulosic fibrous structure having a particularly preferred orientation of the cellulosic fibers can be accomplished. Particularly, the discrete areas may have cellulosic fibers disposed in a substantially radial pattern and be of relatively lower basis weight than the essentially continuous region. A discrete region having radially oriented cellulosic fibers provides the advantage of absorbency for a given opacity over discrete regions having the cellulosic fibers in a random disposition or a nonradial disposition.

To overcome these problems, cellulosic fibrous structures having an essentially continuous high basis weight region and discrete regions of low and intermediate basis weights have been made, particularly wherein the low basis weight region is adjacent the high basis weight region and circumscribes the intermediate basis weight region. An example of such structures, which do not form part of the present invention, can be made in accordance with commonly assigned application Ser. No. 07/722,792 filed Jun. 28, 1991, in the names of Trokhan et al, now U.S. Pat. No. 5,245,025.

However, a plural region cellulosic fibrous structure having discrete intermediate and low basis weight regions has certain drawbacks. Particularly, the fibers in the intermediate basis weight region do not contribute to the load carrying capacity of the cellulosic fibrous structure. Instead, these fibers are bunched together and provide an ocellus which, while helpful for opacity, do not span the discrete low basis weight region and hence do not share in the distribution of applied tensile loadings.

BRIEF SUMMARY OF THE INVENTION

The invention comprises a single lamina cellulosic fibrous structure having at least two regions disposed in a nonrandom, repeating pattern. The first region is of relatively high basis weight and comprises an essentially continuous network. The second region comprises a plurality of mutually discrete regions of relatively low basis weight and which are circumscribed by the high basis weight first region. The low basis weight regions are comprised of a plurality of substantially radially oriented fibers.

In another aspect, the invention comprises a process of producing a single lamina cellulosic fibrous structure having two regions disposed in a nonrandom, repeating pattern. The process comprises the steps of providing a plurality of cellulosic fibers suspended in a liquid carrier, a fiber retentive forming element having liquid pervious zones, and a means for depositing the cellulosic fibers onto the forming element. The cellulosic fibers are deposited onto the forming element and the liquid carrier drained therethrough in two simultaneous stages, a high flow rate stage and a low flow rate stage. The high and low flow rate stages have mutually different initial mass flow rates, whereby the fibers in the low flow rate stage drain in a substantially radially oriented pattern towards a centroid, and thereby form a plurality of discrete regions having relatively lower basis weights than the region formed by the high flow rate stage and radially oriented fibers within the discrete low basis weight regions.

Certain fibers are simultaneously orientationally influenced by both flow areas. This results in a radially oriented bridging of the impervious portion. The low flow area provides this orientational influence without excessive accumulation of fibers over said area.

In yet another aspect, the invention comprises an apparatus for forming a cellulosic fibrous structure having at least two mutually different basis weights disposed in a nonrandom, repeating pattern. The apparatus comprises a liquid pervious fiber retentive forming element having zones through which a liquid carrying the cellulosic fibers may drain, and a means for retaining the cellulosic fibers on the forming element in a nonrandom, repeating pattern of two regions having mutually different basis weights. The two regions comprise a first high basis weight region of an essentially continuous network and a plurality of second low basis weight discrete regions having substantially radially oriented fibers.

The retaining means may comprise a liquid pervious reinforcing structure and a patterned array of protuberances joined thereto. The patterned array of protuberances may have a liquid pervious aperture therethrough, and/or may be radially segmented.

BRIEF DESCRIPTION OF THE DRAWINGS

While the Specification concludes with claims particularly pointing out and distinctly claiming the present invention, it is believed the same will be better understood by the following Specification taken in conjunction with the associated drawings in which like components are given the same reference numeral, analogous components are designated with one or more prime symbols, and:

FIGS. 2$A_1$–2$D_3$ are top plan photomicrographic views of cellulosic fibrous structures having a range of differences in basis weights between the low and high basis weight regions, within each alphabetically labeled series of figures an increasing tendency towards a two basis weight structure is shown as each series is examined in order, and increasing radiality is shown as the subscripted figures are examined in order within each alphabetically labeled series;

FIGS. 3$A_1$–3$D_3$ are top plan photomicrographic views of cellulosic fibrous structures having a range of degrees of radiality present in the low basis weight regions, within each alphabetically labeled series of figures increasing radiality is shown as each series is examined in order, and an increasing tendency towards a two basis weight structure is shown as the subscripted figures are examined within each alphabetically labeled series;

DETAILED DESCRIPTION OF THE INVENTION

THE PRODUCT

Figure 1:
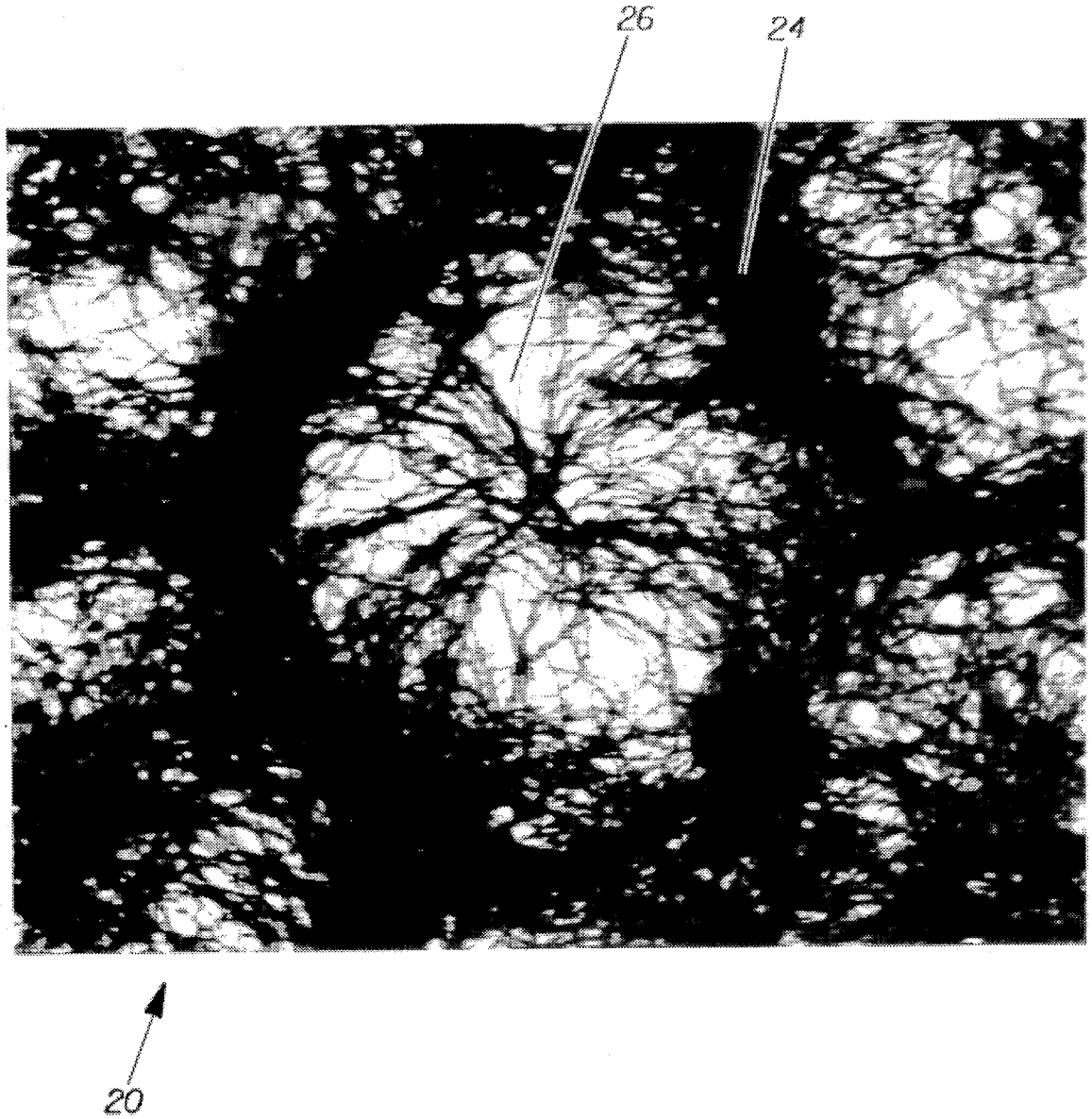
FIG. 1 is a top plan photomicrographic view of a cellulosic fibrous structure according to the present invention having discrete regions with radially oriented cellulosic fibers.

As illustrated in FIG. 1, a cellulosic fibrous structure 20 according to the present invention has two regions: a first high basis weight region 24 and second discrete low basis weight region 26. Each region 24 or 26 is composed of cellulosic fibers which are approximated by linear elements. The cellulosic fibers of the low basis weight regions 26 are disposed in a substantially radial pattern.

The fibers are components of the cellulosic fibrous structure 20 and have one very large dimension (along the longitudinal axis of the fiber) compared to the other two relatively very small dimensions (mutually perpendicular, and being both radial and perpendicular to the longitudinal axis of the fiber), so that linearity is approximated. While microscopic examination of the fibers may reveal two other dimensions which are small, compared to the principal dimension of the fibers, such other two small dimensions need not be substantially equivalent nor constant throughout the axial length of the fiber. It is only important that the fiber be able to bend about its axis, be able to bond to other fibers and be distributed by a liquid carrier.

The fibers comprising the cellulosic fibrous structure 20 may be synthetic, such as polyolefin or polyester; are preferably cellulosic, such as cotton linters, rayon or bagasse; and more preferably are wood pulp, such as soft woods (gymnosperms or coniferous) or hard woods (angiosperms or deciduous). As used herein, a cellulosic fibrous structure is considered "cellulosic" if the cellulosic fibrous structure comprises at least about 50 weight percent or at least about 50 volume percent cellulosic fibers, including but not limited to those fibers listed above. A cellulosic mixture of wood pulp fibers comprising softwood fibers having a length of about 2.0 to about 4.5 millimeters and a diameter of about 25 to about 50 micrometers, and hardwood fibers having a length of less than about 1 millimeter and a diameter of about 12 to about 25 micrometers has been found to work well for the cellulosic fibrous structures 20 described herein.

If wood pulp fibers are selected for the cellulosic fibrous structure 20, the fibers may be produced by any pulping process including chemical processes, such as sulfite, sulphate and soda processes; and mechanical processes such as stone groundwood. Alternatively, the fibers may be produced by combinations of chemical and mechanical processes or may be recycled. The type, combination, and processing of the fibers used are not critical to the present invention.

A cellulosic fibrous structure 20 according to the present invention is macroscopically two-dimensional and planar, although not necessarily flat. The cellulosic fibrous structure 20 may have some thickness in the third dimension. However, the third dimension is very small compared to the actual first two dimensions or to the capability to manufacture a cellulosic fibrous structure 20 having relatively large measurements in the first two dimensions.

The cellulosic fibrous structure 20 according to the present invention comprises a single lamina. However, it is to be recognized that two single laminae, either or both made according to the present invention, may be joined in face-to-face relation to form a unitary laminate. A cellulosic fibrous structure 20 according to the present invention is considered to be a "single lamina" if it is taken off the forming element, discussed below, as a single sheet having a thickness prior to drying which does not change unless fibers are added to or removed from the sheet. The cellulosic fibrous structure 20 may be later embossed, or remain nonembossed, as desired.

The cellulosic fibrous structure 20 according to the present invention may be defined by intensive properties which discriminate regions from each other. For example, the basis weight of the cellulosic fibrous structure 20 is one intensive property which discriminates the regions from each other. As used herein, a property is considered "intensive" if it does not have a value dependent upon the aggregation of values within the plane of the cellulosic fibrous structure 20. Examples of two dimensionally intensive properties include the density, projected capillary size, basis weight, temperature, compressive moduli, tensile moduli, fiber orientation, etc., of the cellulosic fibrous structure 20. As used herein properties which depend upon the aggregation of various values of subsystems or components of the cellulosic fibrous structure 20 are considered "extensive" in all three dimensions. Examples of extensive properties include the weight, mass, volume, and moles of the cellulosic fibrous structure 20. The intensive property most important to the cellulosic fibrous structure 20 described and claimed herein is the basis weight.

The cellulosic fibrous structure 20 according to the present invention has at least two distinct basis weights which are divided between two identifiable areas referred to as "regions" of the cellulosic fibrous structure 20. As used herein, the "basis weight" is the weight, measured in grams force, of a unit area of the cellulosic fibrous structure 20, which unit area is taken in the plane of the cellulosic fibrous structure 20. The size and shape of the unit area from which the basis weight is measured is dependent upon the relative and absolute sizes and shapes of the regions 24 and 26 having the different basis weights.

It will be recognized by one skilled in the art that within a given region 24 or 26, ordinary and expected basis weight fluctuations and variations may occur, when such given region 24 or 26 is considered to have one basis weight. For example, if on a microscopic level, the basis weight of an interstice between fibers is measured, an apparent basis weight of zero will result when, in fact, unless an aperture in the cellulosic fibrous structure 20 is being measured, the basis weight of such region 24 or 26 is greater than zero. Such fluctuations and variations are a normal and expected result of the manufacturing process.

It is not necessary that exact boundaries divide adjacent regions 24 or 26 of different basis weights, or that a sharp demarcation between adjacent regions 24 or 26 of different basis weights be apparent at all. It is only important that the distribution of fibers per unit area be different in different positions of the cellulosic fibrous structure 20 and that such different distribution occurs in a nonrandom, repeating pattern. Such nonrandom repeating pattern corresponds to a nonrandom repeating pattern in the topography of the liquid pervious fiber retentive forming element used to manufacture the cellulosic fibrous structure 20.

While it may be desirable from an opacity standpoint to have a uniform basis weight throughout the cellulosic fibrous structure 20, a uniform basis weight cellulosic fibrous structure 20 does not optimize other properties of the cellulosic fibrous structure 20. The different basis weights of the different regions 24 and 26 of a cellulosic fibrous structure 20 according to the present invention provide for different properties within each of the regions 24 and 26.

For example, the high basis weight regions 24 provide tensile load carrying capability, a preferred absorbent rate, and imparts opacity to the cellulosic fibrous structure 20. The low basis weight regions 26 provide for storage of absorbed liquids when the high basis weight regions 24 become saturated and for economization of fibers.

Preferably, the nonrandom repeating pattern tesselates, so that adjacent regions 24 and 26 are cooperatively and advantageously juxtaposed. By being "nonrandom," the intensively defined regions 24 and 26 are considered to be predictable, and may occur as a result of known and predetermined features of the apparatus used in the manufacturing process. As used herein, the term "repeating" indicates pattern is formed more than once in the cellulosic fibrous structure 20.

Of course, it is to be recognized that if the cellulosic fibrous structure 20 is very large as manufactured, and the regions 24 and 26 are very small compared to the size of the cellulosic fibrous structure 20 during manufacture, i.e., varying by several orders of magnitude, absolute predictability of the exact dispersion and patterns between the regions 24 and 26 may be very difficult or even impossible and yet the pattern still be considered nonrandom. However, it is only important that such intensively defined regions 24 and 26 be dispersed in a pattern substantially as desired to yield the performance properties which render the cellulosic fibrous structure 20 suitable for its intended purpose.

The intensively discriminated regions 24 and 26 of the cellulosic fibrous structure 20 may be "discrete," so that adjacent regions 24 or 26 having the same basis weight are not contiguous. Alternatively, a region 24 or 26 may be continuous.

It will be apparent to one skilled in the art that there may be small transition regions having a basis weight intermediate the basis weights of the adjacent regions 24 or 26, which transition regions by themselves may not be significant enough in area to be considered as comprising a basis weight distinct from the basis weights of either adjacent region 24 or 26. Such transition regions are within the normal manufacturing variations known and inherent in producing a cellulosic fibrous structure 20 according to the present invention.

The size of the pattern of the cellulosic fibrous structure 20 may vary from about 3 to about 78 discrete regions 26 per square centimeter (from 20 to 500 discrete regions 26 per square inch), and preferably from about 16 to about 47 discrete regions 26 per square centimeter (from 100 to 300 discrete regions 26 per square inch).

It will be apparent to one skilled in the art that as the pattern becomes finer (having more discrete regions 24 or 26 per square centimeter) a relatively larger percentage of the smaller sized hardwood fibers may be utilized, and the percentage of the larger sized softwood fibers may be correspondingly reduced. If too many larger sized fibers are utilized, such fibers may not be able to conform to the topography of the apparatus, described below, which produces the cellulosic fibrous structure 20. If the fibers do not properly conform, such fibers may bridge various topographical regions of the apparatus, leading to a nonpatterned cellulosic fibrous structure 20. A cellulosic fibrous structure comprising about 100 percent hardwood fibers, particularly Brazilian eucalyptus, has been found to work well for a cellulosic fibrous structure 20 having about 31 discrete regions 26 per square centimeter (200 discrete regions 26 per square inch).

If the cellulosic fibrous structure 20 illustrated in FIG. 1 is to be used as a consumer product, such as a paper towel or a tissue, the high basis weight region 24 of the cellulosic fibrous structure 20 is preferably essentially continuous in two orthogonal directions within the plane of the cellulosic fibrous structure 20. It is not necessary that such orthogonal directions be parallel and perpendicular the edges of the finished product or be parallel and perpendicular the direction of manufacture of the product, but only that tensile strength be imparted to the cellulosic fibrous structure in two orthogonal directions, so that any applied tensile loading may be more readily accommodated without premature failure of the product due to such tensile loading. Preferably, the continuous direction is parallel the direction of expected tensile loading of the finished product according to the present invention.

The high basis weight region 24 is essentially continuous, forming an essentially continuous network, for the embodiments described herein and extends substantially throughout the cellulosic fibrous structure 20. Conversely, the low basis weight regions 26 are discrete and isolated from one another, being separated by the high basis weight region 24.

An example of an essentially continuous network is the high basis weight region 24 of the cellulosic fibrous structure 20 of FIG. 1. Other examples of cellulosic fibrous structures having essentially continuous networks are disclosed in commonly assigned U.S. Pat. No. 4,637,859 issued Jan. 20, 1987 to Trokhan and incorporated herein by reference for the purpose of showing another cellulosic fibrous structure having an essentially continuous network. Interruptions in the essentially continuous network are tolerable, albeit not preferred, so long as such interruptions do not substantially adversely affect the material properties of such portion of the cellulosic fibrous structure 20.

Conversely, the low basis weight regions 26 may be discrete and dispersed throughout the high basis weight essentially continuous network 24. The low basis weight regions 26 may be thought of as islands which are surrounded by a circumjacent essentially continuous network high basis weight region 24. The discrete low basis weight regions 26 also form a nonrandom, repeating pattern.

The discrete low basis weight regions 26 may be staggered in, or may be aligned in, either or both of the aforementioned two orthogonal directions. Preferably, the high basis weight essentially continuous network 24 forms a patterned network circumjacent the discrete low basis weight regions 26, although, as noted above, small transition regions may be accommodated.

Differences in basis weights (within the same cellulosic fibrous structure 20) between the high and low basis weight regions 24 and 26 of at least 25 percent are considered to be significant for the present invention. If a quantitative determination of basis weight in each of the regions 24 and 26 is desired, and hence a quantitative determination of the differences in basis weight between such regions 24 and 26 is desired, the quantitative methods, such as image analysis of soft X-rays as disclosed in commonly assigned U.S. patent application Ser. No. 07/724,551 filed Jun. 28, 1991 in the names of Phan et al. may be utilized, which patent application is incorporated herein by reference for the purpose of showing suitable methods to quantitatively determine the basis weights of the regions 24 and 26 of the cellulosic fibrous structure 20.

The area of a given low or intermediate basis weight region 26 or 25 may be quantitatively determined by overlaying a photograph of such region 26 or 25 with a constant thickness, constant density transparent sheet. The border of the region 26 or 25 is traced in a color contrasting to that of the photograph. The outline is cut as accurately as possible along the tracing and then weighed. This weight is compared to the weight of a similar sheet having a unit area, or other known area. The ratio of the weights of the sheets is directly proportional to the ratio of the two areas.

If one desires to know the relative surface area of two regions, such as the percentage surface area of an intermediate basis weight region 25 within a low basis weight region 26, the low basis weight region 26 sheet may be weighed. A tracing of the border of the intermediate basis weight region 25 is then cut from the sheet and this sheet is weighed. The ratio of these weights gives the ratio of the areas.

Differences in basis weight between the two regions 24 or 26 may be qualitatively and semi-quantitatively determined by a scale of increasing differences, illustrated by Figures series 2A through Figure series 2D respectively.

FIGS. $2A_1$–$2A_3$ show the low basis weight regions 26 are either apertured, as illustrated in FIG. $2A_1$, or, have a very prominent intermediate basis weight region 25 formed therein, as illustrated in FIGS. $2A_2$"$2A_3$. Increasing radiality is present, as FIGS. $2A_1$–$2A_3$ are studied in order.

FIG. $28_1$ illustrates a cellulosic fibrous structure 20 still having an intermediate basis weight region 25, which intermediate basis weight region 25 is less prominent than that of FIGS. $2A_2$–$2A_3$.

FIG. $2C_1$ shows only an incipient formation of an intermediate basis weight region 25 to be present. The intermediate basis weight region 25 is barely apparent and may be considered to be either nonexistent or so close in basis weight (less than 25 percent) to that of the low basis weight region 26, that it is not present for purposes of the present invention.

FIGS. $2D_1$–$2D_3$ show cellulosic fibrous structures 20 having no intermediate basis weight region 25. Although the fibers may range from being very randomly oriented, as illustrated in FIG. $2D_1$, to being very radially oriented, as illustrated in FIG. $2D_3$, no intermediate basis weight regions 25, aperturing, or significant basis weight nonuniformity within the low basis weight regions 26 are present.

Generally, for purposes of the present invention, a cellulosic fibrous structure 20 is considered to have only two regions 24 and 26 if the presence of any intermediate basis weight region 25 is less than about 5 percent of the surface area of the entire low basis weight region 26, inclusive of any intermediate basis weight region 25, or if the basis weight of the intermediate basis weight region 25 is within about 25 percent of the basis weight of the low basis weight region 26.

By way of example, the intermediate basis weight region 25 in FIG. $2C_1$ is about 4 percent of the total of the area of the low basis weight region 26. For purposes of the invention described and claimed herein, the cellulosic fibrous structures 20 illustrated in FIGS. $2C_1$–$2D_3$ are considered to have the claimed high and low basis weight regions 24 and 26 and to meet the two region criterion of the claims.

The fibers of the two regions 24 and 26 may be advantageously aligned in different directions. For example, the fibers comprising the essentially continuous high basis weight region 24 may be preferentially aligned in a generally singular direction, corresponding to the essentially continuous network of the annuluses 65 between adjacent protuberances 59 and the influence of the machine direction of the manufacturing process, as illustrated in FIG. 1.

This alignment provides for fibers to be generally mutually parallel and have a relatively high degree of bonding. The relatively high degree of bonding produces a relatively high tensile strength in the high basis weight region 24. Such high tensile strength in the relatively high basis weight region 24 is generally advantageous, because the high basis weight region 24 carries and transmits applied tensile loading throughout the cellulosic fibrous structure 20.

The low basis weight region 26 comprises fibers which are substantially radially oriented and emanate outwardly from the centers of each of the low basis weight regions 26. Whether or not fibers are considered "substantially radially oriented" for purposes of this invention, is determined by a scale of increasing radiality, illustrated by Figures series 3A through Figure series 3D respectively.

FIGS. $3A_1$–$3A_3$ illustrate cellulosic fibrous structures 20 having low basis weight regions 26 without a plurality of substantially radially oriented fibers. In particular, FIG. $3A_1$ illustrates a cellulosic fibrous structure 20 having only one radially oriented strand of fibers, and consequently, poor radial symmetry. FIGS. $3A_2$–$3A_3$ show low basis weight regions 26 having generally random fiber distributions. An increasing tendency towards a two basis weight cellulosic fibrous structure 20 is observed as FIGS. $3A_1$–$3A_3$ are studied in order.

FIG. $38_1$ illustrates a cellulosic fibrous structure 20 having a somewhat more radial fiber distribution, but still having very poor radial symmetry of these fibers.

FIGS. $3C_1$–$3C_2$ show cellulosic fibrous structures 20 having low basis weight regions 26 with substantially radially oriented cellulosic fibers in the low basis weight regions 26. The radially oriented fibers are fairly isomerically distributed throughout all four quadrants, promoting radial symmetry, and only a small percentage of nonradially oriented fibers is present.

Referring to FIGS. $3D_1$–$3D_3$, cellulosic fibrous structures 20 having extremely radially oriented fiber distributions within the low basis weight regions 26 are illustrated. While an increasing tendency towards a two basis weight cellulosic fibrous structure 20 is observed as FIGS. $3D_1$–$3D_3$ are studied in order, each of the cellulosic fibrous structures 20 illustrated by FIGS. $3D_1$–$3D_3$ has only a minimal percentage of nonradially oriented fibers. FIGS. $3D_1$–$3D_3$ also illustrate good radial symmetry within the low basis weight regions 26.

Generally, for purposes of the present invention, cellulosic fibrous structures 20 having a degree of radiality at least as great as illustrated by FIGS. $3C_1$–$3C_2$, and preferably at least as great as illustrated by FIGS. $3D_1$–$3D_3$, are considered to be "substantially radially oriented" and to meet the radiality criterion of the claims. FIGS. 1, $2C_1$, $2D_3$, $3C_1$, $3C_2$, $3D_2$, and $3D_3$ illustrate cellulosic fibrous structures 20 having a low basis weight region 26 which meets both criteria and therefore fall within the scope of the claimed invention (and are the only figures illustrated hereunder which fall within the claimed scope).

It is, of course, understood that not all of the low basis weight regions 26 within a particular cellulosic fibrous structure 20 will meet both (or necessarily either) of the aforementioned criteria of radiality and being of low basis weight. Due to normal and expected variations in the manufacturing process, some low basis weight regions 26 within the cellulosic fibrous structure 20 may not be considered to have two regions, as set forth above, or not have a plurality of substantially radially oriented fibers, as set forth above, yet other (even adjacent) low basis weight regions 26 may meet both criteria. For purposes of the present invention, a cellulosic fibrous structure 20 preferably has at least 10 percent, and more preferably at least 20 percent, of the low basis weight regions 20 within both of the criteria specified above.

Since it is impractical to study each low basis weight region 26 within a given cellulosic fibrous structure 20, the percentage of low basis weight regions 26 meeting the criteria may be determined as follows.

The cellulosic fibrous structure 20 is divided into thirds, yielding three trisections which are preferably oriented in the machine direction (if known). A Cartesian coordinate system is arranged in each trisection with units corresponding to the machine and cross machine direction pitches of the low basis weight regions 26. Using any random number generator, 33 sets of coordinate points are selected for each outboard trisection and 34 sets of coordinate points are selected for the central trisection, yielding a total of 100 coordinate points. Each coordinate point corresponds to a low basis weight region 26. If a coordinate point does not coincide with a low basis weight region 26, but instead coincides with the high basis weight region 24, the low basis weight region 26 closest to that coordinate point is selected.

The 100 low basis weight regions 26 thus designated are analyzed as set forth above, utilizing magnification and photomicroscopy as desired. The percentage of low basis weight regions 26 meeting both criteria determines the percentage for that particular cellulosic fibrous structure 20.

Of course, if a particular cellulosic fibrous structure 20 does not have 100 low basis weight regions 26, or a representative sampling of several individual cellulosic fibrous structures 20 is desired, the 100 points may be spread among several individual cellulosic fibrous structures 20 and aggregated to determine the percentage for that sampling.

Of course, the individual cellulosic fibrous structures 20 should be randomly selected, to maximize the opportunity to achieve a truly representative sampling. The individual cellulosic fibrous structure 20 may be randomly selected by assigning a sequential number to each cellulosic fibrous structure 20 in the package or roll. The numbered cellulosic fibrous structures 20 are selected at random, using another random number generator, so that 1 to 10 cellulosic fibrous structures 20 are available for analysis. The 100 Cartesian points are divided, as evenly as possible, between the 1–10 individual cellulosic fibrous structures 20. The low basis weight regions 26 corresponding to these Cartesian points are then analyzed as set forth above.

THE APPARATUS

Figure 4:
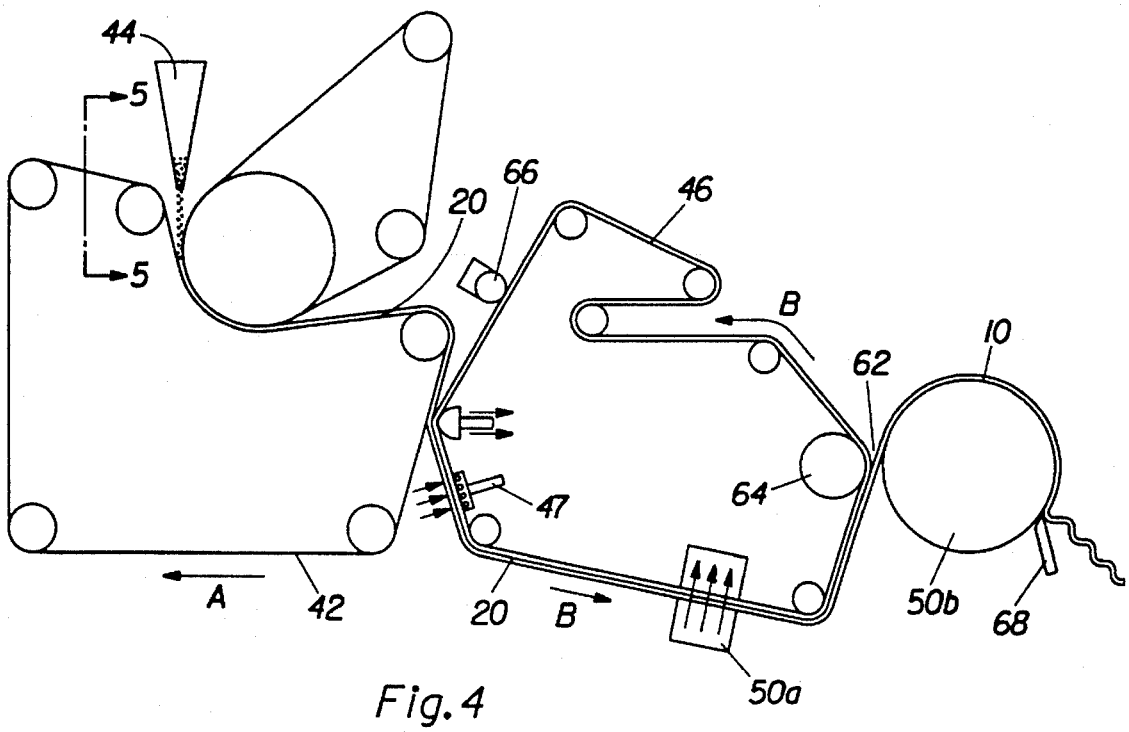
FIG. 4 is a schematic side elevational view of an apparatus which may be utilized to make the cellulosic fibrous structure according to the present invention.

Many components of the apparatus used to make a cellulosic fibrous structure 20 according to the present invention are well known in the art of papermaking. As illustrated in FIG. 4, the apparatus may comprise a means 44 for depositing a liquid carrier and cellulosic fibers entrained therein onto a liquid pervious fiber retentive forming element 42.

The liquid pervious fiber retentive forming element 42 may be a forming belt 42, is the heart of the apparatus and represents one component of the apparatus which departs from the prior art to manufacture the cellulosic fibrous structures 20 described and claimed herein. Particularly, the liquid pervious fiber retentive forming element has protuberances 59 which form the low basis weight regions 26 of the cellulosic fibrous structure 20, and intermediate annuluses 65 which form the high basis weight regions 24 of the cellulosic fibrous structure 20.

The apparatus may further comprise a secondary belt 46 to which the cellulosic fibrous structure 20 is transferred after the majority of the liquid carrier is drained away and the cellulosic fibers are retained on the forming belt 42. The secondary belt 46 may further comprise a pattern of knuckles or projections not coincident the regions 24 and 26 of the cellulosic fibrous structure 20. The forming and secondary belts 42 and 46 travel in the directions depicted by arrows A and B respectively.

After deposition of the liquid carrier and entrained cellulosic fibers onto the forming belt 42, the cellulosic fibrous structure 20 is dried according to either or both of known drying means 50*a* and 50*b*, such as a blow through dryer 50*a*, and/or a Yankee drying drum 50*b*. Also, the apparatus may comprise a means, such as a doctor blade 68, for fore-shortening or creping the cellulosic fibrous structure 20.

Figure 5:
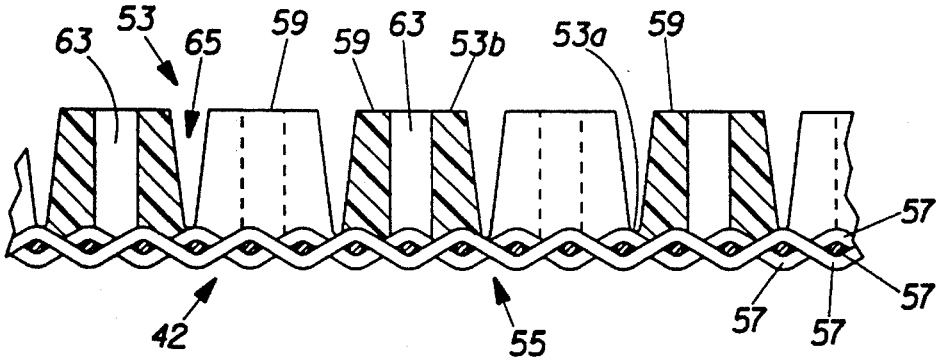
FIG. 5 is a fragmentary side elevational view of a forming element having apertures through the protuberances and taken along line 5—5 of FIG. 4.

If a forming belt 42 is selected for the forming element 42 of the apparatus used to make the cellulosic fibrous structure 20, the forming belt 42 has two mutually opposed faces, a first face 53 and a second face 55, as illustrated in FIG. 5. The first face 53 is the surface of the forming belt 42 which contacts the fibers of the cellulosic structure 20 being formed. The first face 53 is referred to in the art as the paper contacting side of the forming belt 42. The first face 53 has two topographically distinct regions 53*a* and 53*b*. The regions 53*a* and 53*b* are distinguished by the amount of orthogonal variation from the second and opposite face 55 of the forming belt 42. Such orthogonal variation is considered to be in the Z-direction. As used herein the "Z-direction" refers to the direction away from and generally orthogonal to the XY plane of the forming belt 42, considering the forming belt 42 to be a planar, two-dimensional structure.

The forming belt 42 should be able to withstand all of the known stresses and operating conditions in which cellulosic, two-dimensional structures are processed and manufactured. A particularly preferred forming belt 42 may be made according to the teachings of commonly assigned U.S. Pat. No. 4,514,345 issued Apr. 30, 1985 to Johnson et al., and particularly according to FIG. 5 of Johnson et al., which patent is incorporated herein by reference for the purpose of showing a particularly suitable forming element 42 for use with the present invention and a method of making such forming element 42.

The forming belt 42 is liquid pervious in at least one direction, particularly the direction from the first face 53 of the belt, through the forming belt 42, to the second face 55 of the forming belt 42. As used herein "liquid pervious" refers to the condition where the liquid carrier of a fibrous slurry may be transmitted through the forming belt 42 without significant obstruction. It may, of course, be helpful or even necessary to apply a slight differential pressure to assist in transmission of the liquid through the forming belt 42 to insure that the forming belt 42 has the proper degree of perviousness.

It is not, however, necessary, or even desired, that the entire surface area of the forming belt 42 be liquid pervious. It is only necessary that the liquid carrier of the fibrous slurry be easily removed from the slurry leaving on the first face 53 of the forming belt 42 an embryonic cellulosic fibrous structure 20 of the deposited fibers.

The forming belt 42 is also fiber retentive. As used herein a component is considered "fiber retentive" if such component retains a majority of the fibers deposited thereon in a macroscopically predetermined pattern or geometry, without regard to the orientation or disposition of any particular fiber. Of course, it is not expected that a fiber retentive component will retain one hundred percent of the fibers deposited thereon (particularly as the liquid carrier of the fibers drains away from such component) nor that such retention be permanent. It is only necessary that the fibers be retained on the forming belt 42, or other fiber retentive component, for a period of time sufficient to allow the steps of the process to be satisfactorily completed.

The forming belt 42 may be thought of as having a reinforcing structure 57 and a patterned array of protuberances 59 joined in face to face relation to the reinforcing structure 57, to define the two mutually opposed faces 53 and 55. The reinforcing structure 57 may comprise a foraminous element, such as a woven screen or other apertured framework. The reinforcing structure 57 is substantially liquid pervious. A suitable foraminous reinforcing structure 57 is a screen having a mesh size of about 6 to about 30 filaments per centimeter. The openings between the filaments may be generally square, as illustrated, or of any other desired cross-section. The filaments may be formed of polyester strands, woven or nonwoven fabrics. Particularly, a 48×52 mesh dual layer reinforcing structure 57 has been found to work well.

One face 55 of the reinforcing structure 57 may be essentially macroscopically monoplanar and comprises the outwardly oriented face 53 of the forming belt 42. The inwardly oriented face of the forming belt 42 is often referred to as the backside of the forming belt 42 and, as noted above, contacts at least part of the balance of the apparatus employed in a papermaking operation. The opposing and outwardly oriented face 53 of the reinforcing structure 57 may be referred to as the fiber-contacting side of the forming belt 42, because the fibrous slurry, discussed above, is deposited onto this face 53 of the forming belt 42.

The patterned array of protuberances 59 is joined to the reinforcing structure 57 and preferably comprises individual protuberances 59 joined to and extending outwardly from the inwardly oriented face 53 of the reinforcing structure 57 as illustrated in FIG. 5. The protuberances 59 are also considered to be fiber contacting, because the patterned array of protuberances 59 receives, and indeed may be covered by, the fibrous slurry as it is deposited onto the forming belt 42.

The protuberances 59 may be joined to the reinforcing structure 57 in any known manner, with a particularly preferred manner being joining a plurality of the protuberances 59 to the reinforcing structure 57 as a batch process incorporating a hardenable polymeric photosensitive resin—rather than individually joining each protuberance 59 of the patterned array of protuberances 59 to the reinforcing structure 57. The patterned array of protuberances 59 is preferably formed by manipulating a mass of generally liquid material so that, when solidified, such material is contiguous with and forms part of the protuberances 59 and at least partially surrounds the reinforcing structure 57 in contacting relationship, as illustrated in FIG. 5.

Figure 6:
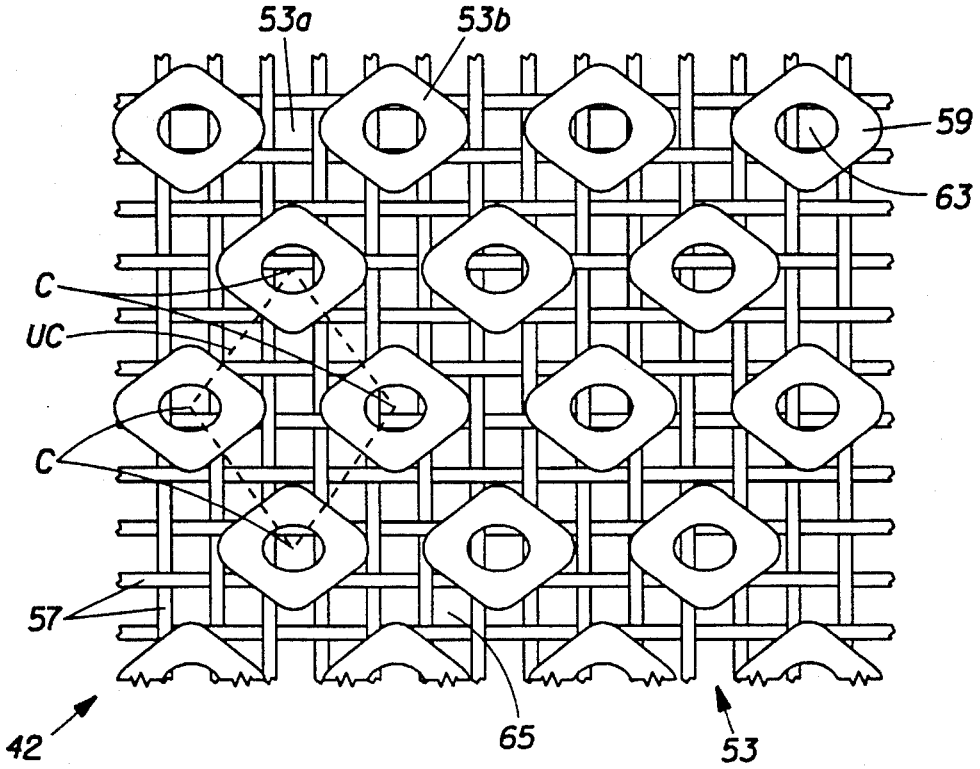
FIG. 6 is a fragmentary top plan view of the forming element of FIG. 5.

As illustrated in FIG. 6, the patterned array of protuberances 59 should be arranged so that a plurality of conduits, into which fibers of the fibrous slurry may deflect, extend in the Z-direction from the free ends 53*b* of the protuberances 59 to the proximal elevation 53*a* of the outwardly oriented face 53 of the reinforcing structure 57. This arrangement provides a defined topography to the forming belt 42 and allows for the liquid carrier and fibers therein to flow to the reinforcing structure 57. The annuluses 65 between adjacent protuberances 59 form conduits having a defined flow resistance which is dependent upon the pattern, size and spacing of the protuberances 59.

The protuberances 59 are discrete and preferably regularly spaced so that large scale weak spots in the essentially continuous network 24 of the cellulosic fibrous structure 20 are not formed. The liquid carrier may drain through the annuluses 65 between adjacent protuberances 59 to the reinforcing structure 57 and deposit fibers thereon. More preferably, the protuberances 59 are distributed in a nonrandom repeating pattern so that the essentially continuous network 24 of the cellulosic fibrous structure 20 (which is formed around and between the protuberances 59) more uniformly distributes applied tensile loading throughout the cellulosic fibrous structure 20. Most preferably, the protuberances 59 are bilaterally staggered in an array, so that adjacent low basis weight regions 26 in the resulting cellulosic fibrous structure 20 are not aligned with either principal direction to which tensile loading may be applied.

Referring back to FIG. 5, the protuberances 59 are upstanding and joined at their proximal ends 53*a* to the outwardly oriented face 53 of the reinforcing structure 57 and extend away from this face 53 to a distal or free end 53*b* which defines the furthest orthogonal variation of the patterned array of protuberances 59 from the outwardly oriented face 53 of the reinforcing structure 57. Thus, the outwardly oriented face 53 of the forming belt 42 is defined at two elevations. The proximal elevation of the outwardly oriented face 53 is defined by the surface of the reinforcing structure 57 to which the proximal ends 53*a* of the protuberances 59 are joined, taking into account, of course, any material of the protuberances 59 which surrounds the reinforcing structure 57 upon solidification. The distal elevation of the outwardly oriented face 53 is defined by the free ends 53*b* of the patterned array of protuberances 59. The opposed and inwardly oriented face 55 of the forming belt 42 is defined by the other face of the reinforcing structure 57, taking into account, of course, any material of the protuberances 59 which surrounds the reinforcing structure 57 upon solidification, which face is opposite the direction of extent of the protuberances 59.

The protuberances 59 may extend, orthogonal the plane of the forming belt 42, outwardly from the proximal elevation of the outwardly oriented face 53 of the reinforcing structure 57 about 0.05 millimeters to about 1.3 millimeters (0.002 to 0.050 inches). Obviously, if the protuberances 59 have zero extent in the Z-direction, a more nearly constant basis weight cellulosic fibrous structure 20 results. Thus, if it is desired to minimize the difference in basis weights between adjacent high basis weight regions 24 and low basis weight regions 26 of the cellulosic fibrous structure 20, generally shorter protuberances 59 should be utilized.

As illustrated in FIG. 6, the protuberances 59 preferably do not have sharp corners, particularly in the XY plane, so that stress concentrations in the resulting low basis weight regions 26 of the cellulosic fibrous structure 20 of FIG. 1 are obviated. A particularly preferred protuberance 59 is curvirhombohedrally shaped, having a cross-section which resembles a rhombus with radiused corners.

Without regard to the cross-sectional area of the protuberances 59, the sides of the protuberances 59 may be generally mutually parallel and orthogonal the plane of the forming belt 42. Alternatively, the protuberances 59 may be somewhat tapered, yielding a frustroconical shape, as illustrated in FIG. 5.

It is not necessary that the protuberances 59 be of uniform height or that the free ends 53*b* of the protuberances 59 be equally spaced from the proximal elevation 53*a* of the outwardly oriented face 53 of the reinforcing structure 57. If it is desired to incorporate more complex patterns than those illustrated into the cellulosic fibrous structure 20, it will be understood by one skilled in the art that this may be accomplished by having a topography defined by several Z-directional levels of upstanding protuberances 59—each level yielding a different basis weight than occurs in the regions of the cellulosic fibrous structure 20 defined by the protuberances 59 of the other levels. Alternatively, this may be otherwise accomplished by a forming belt 42 having an outwardly oriented face 53 defined by more than two elevations by some other means, for example, having uniform sized protuberances 59 joined to a reinforcing structure 57 having a planarity which significantly varies relative to the Z-direction extent of the protuberances 59.

As illustrated in FIG. 6, the patterned array of protuberances 59 may, preferably, range in area, as a percentage of the projected surface area of the forming belt 42, from a minimum of about 20 percent of the total projected surface area of the forming belt 42 to a maximum of about 80 percent of the total projected surface area of the forming belt 42, without considering the contribution of the reinforcing structure 57 to the projected surface area of the forming belt 42. The contribution of the patterned array of protuberances 59 to the total projected surface area of the forming belt 42 is taken as the aggregate of the projected area of each protuberance 59 taken at the maximum projection against an orthogonal to the outwardly oriented face 53 of the reinforcing structure 57.

It is to be recognized that as the contribution of the protuberances 59 to the total surface area of the forming belt 42 diminishes, the previously described high basis weight essentially continuous network 24 of the cellulosic fibrous structure 20 increases, minimizing the economic use of raw materials. Further, the distance between the mutually opposed sides of adjacent protuberances 59 of the forming belt 42 should be increased as the length of the fibers increases, otherwise the fibers may bridge adjacent protuberances 59 and hence not penetrate the conduits between adjacent protuberances 59 to the reinforcing structure 57 defined by the surface area of the proximal elevation 53*a*.

The second face 55 of the forming belt 42 may have a defined and noticeable topography or may be essentially macroscopically monoplanar. As used herein "essentially macroscopically monoplanar" refers to the geometry of the forming belt 42 when it is placed in a two-dimensional configuration and has only minor and tolerable deviations from absolute planarity, which deviations do not adversely affect the performance of the forming belt 42 in producing cellulosic fibrous structures 20 as described above and claimed below. Either geometry of the second face 55, topographical or essentially macroscopically monoplanar, is acceptable, so long as the topography of the first face 53 of the forming belt 42 is not interrupted by deviations of larger magnitude, and the forming belt 42 can be used with the process steps described herein. The second face 55 of the forming belt 42 may contact the equipment used in the process of making the cellulosic fibrous structure 20 and has been referred to in the art as the machine side of the forming belt 42.

The protuberances 59 define annuluses 65 having multiple and different flow resistances in the liquid pervious portion of the forming belt 42. One manner in which differing regions may be provided is illustrated in FIG. 6. Each protuberance 59 of the forming belt of FIG. 6 may be substantially equally spaced from the adjacent protuberance 59, providing an essentially continuous network annulus 65 between adjacent protuberances 59.

Extending in the Z-direction through the approximate center of a plurality of the protuberances 59 or, through each of the protuberances 59, is an aperture 63 which provides fluid communication between the free end **53*b* of the protuberance 59 and the proximal elevation 53*a* of the outwardly oriented face 53 of the reinforcing structure 57**.

The flow resistance of the aperture 63 through the protuberance 59 is different from, and typically greater than the flow resistance of the annulus 65 between adjacent protuberances 59. Therefore, typically more of the liquid carrier will drain through the annuluses 65 between adjacent protuberances 59 than through the aperture 63 within and circumscribed by the free end **53*b* of a particular protuberance 59. Because less liquid carrier drains through the aperture 63, than through the annulus 65 between adjacent protuberances 59, relatively more fibers are deposited onto the reinforcing structure 57 subjacent the annulus 65 between adjacent protuberances 59 than onto the reinforcing structure 57 subjacent the apertures 63**.

The annuluses 65 and apertures 63 respectively define high flow rate and low flow rate zones in the forming belt 42. The initial mass flow rate of the liquid carrier through the annuluses 65 is greater than the initial mass flow rate of the liquid carrier through the apertures 63.

It will be recognized that no liquid carrier will flow through the protuberances 59, because the protuberances 59 are impervious to the liquid carrier. However, depending upon the elevation of the distal ends **53*b* of the protuberances 59 and the length of the cellulosic fibers, cellulosic fibers may be deposited on the distal ends 53*b* of the protuberances 59**.

As used herein, the "initial mass flow rate" refers to the flow rate of the liquid carrier when it is first introduced to and deposited upon the forming belt 42. Of course, it will be recognized that both flow rate zones will decrease in mass flow rate as a function of time as the apertures 63 or annuluses 65 which define the zones become obturated with cellulosic fibers suspended in the liquid carrier and retained by the forming belt 42. The difference in flow resistance between the apertures 63 and the annuluses 65 provides a means for retaining different basis weights of cellulosic fibers in a pattern in the different zones of the forming belt 42.

This difference in flow rates through the zones is referred to as "staged draining," in recognition that a step discontinuity exists between the initial flow rate of the liquid carrier through the high and low flow rate zones. Staged draining can be advantageously used, as described above, to deposit different amounts of fibers in a tessellating pattern in the different regions 24 and the cellulosic fibrous structure 20.

More particularly, the high basis weight regions 24 will occur in a nonrandom repeating pattern substantially corresponding to the high flow rate zones (the annuluses 65) of the forming belt 42 and to the high flow rate stage of the process used to manufacture the cellulosic fibrous structure 20. The low basis weight regions 26 will occur in a nonrandom repeating pattern substantially corresponding to the low flow rate zones (the apertures 63 and protuberances 59) of the forming belt 42 and to the low flow rate stage of the process used to manufacture the cellulosic fibrous structure 20.

The flow resistance of the entire forming belt 42 can be easily measured according to techniques well known to one skilled in the art. However, measuring the flow resistance of the high and low flow rate zones, and the differences in flow resistance therebetween is more difficult due to the small size of the high and low flow rate zones. However, flow resistance may be inferred from the hydraulic radius of the zone under consideration. Generally flow resistance is inversely proportional to the hydraulic radius.

The hydraulic radius of a zone is defined as the area of the zone divided by the wetted perimeter of the zone. The denominator frequently includes a constant, such as 4. However, since, for this purpose, it is only important to examine differences between the hydraulic radii of the zones, the constant may either be included or omitted as desired. Algebraically this may be expressed as:

$$\text{Hydraulic Radius} = \frac{\text{Flow Area}}{k \times \text{Wetted Perimeter}}$$

wherein the flow area is the area through the aperture 63 of the protuberance 59, or the flow area between adjacent protuberances 59, as more fully defined below and the wetted perimeter is the linear dimension of the perimeter of the zone in contact with the liquid carrier. The hydraulic radii of several common shapes is well known and can be found in many references such as Mark's Standard Handbook for Mechanical Engineers, eighth edition, which reference is incorporated herein by reference for the purpose of showing the hydraulic radius of several common shapes and a teaching of how to find the hydraulic radius of irregular shapes.

The hydraulic radius of a given forming element 42, or portion thereof, may be calculated by considering any unit cell, i.e., the smallest repeating unit which defines a full protuberance 59 and the annulus 65 which circumscribes the protuberance 59. Of course, the unit cell should measure the hydraulic radii at the elevation of the protuberances 59 and annuluses 65 which provide the greatest restriction to flow. For example, the height of a photosensitive resin protuberance 59 from the reinforcing structure 57 may influence its flow resistance. If the protuberances 59 are tapered, a correction to the calculated hydraulic radius may be incorporated by considering the air permeability of the forming element 42, as discussed below relative to Table I.

Without such correction, the apparent ratio of the hydraulic radii, discussed below, may be less than that actually present on the forming element 42. The ratios of hydraulic radii given in the Examples below are uncorrected, but work well for such Examples.

Referring to FIG. 6, one possible unit cell for the forming element 42 is illustrated by the dashed lines C—C. Of course, any boundaries which are created by the unit cell, but which do not constitute wetted perimeter of the flow path are not considered when calculating the hydraulic radius.

The flow area used to calculate the hydraulic radius does not take into consideration any restrictions imposed by the reinforcing structure 57 underneath the protuberances 59. Of course, it will be recognized that as the size of the apertures 63 decreases, either due to a smaller sized pattern being selected, or the diameter of the aperture 63 being smaller, a cellulosic fibrous structure 20 may result which does not have the requisite radiality in the low basis weight regions 26 or even have three regions discriminated by basis weight. Such deviations may be due to the flow resistance imparted by the reinforcing structure 20.

For the forming elements 42, illustrated in FIG. 6, the two zones of interest are defined as follows. The selected zones comprise the annular perimeter circumscribing a protuberance 59. The extent of the annular perimeter in the XY direction for a given protuberance 59 is one-half of the radial distance from the protuberance 59 to the adjacent protuberance 59. Thus, the region 69 between adjacent protuberances 59 will have a border, centered therein, which is coterminous the annular perimeter of the adjacent protuberances 59 defining such annulus 65 between the adjacent protuberances 59.

Furthermore, because the protuberances 59 extend in the Z-direction to an elevation above that of the balance of the reinforcing structure 57, fewer fibers will be deposited in the regions superjacent the protuberances 59, because the fibers deposited on the portions of the reinforcing structure 57 corresponding to the apertures 63 and annuluses 65 between adjacent protuberances must build up to the elevation of the free ends **53*b* of the protuberances 59, before additional fibers will remain on top of the protuberances 59 without being drained into either the aperture 63 or annulus 65 between adjacent protuberances 59**.

One nonlimiting example of a forming belt 42 which has been found to work well in accordance with the present invention has a 52 dual mesh weave reinforcing structure 57. The reinforcing structure 57 is made of filaments having a warp diameter of about 0.15 millimeters (0.006 inches) a shute diameter of about 0.18 millimeters (0.007 inches) with about 45–50 percent open area. The reinforcing structure 57 can pass approximately 36,300 standard liters per minute (1,280 standard cubic feet per minute) air flow at a differential pressure of about 12.7 millimeters (0.5 inches) of water. The thickness of the reinforcing structure 57 is about 0.76 millimeters (0.03 inches), taking into account the knuckles formed by the woven pattern between the two faces 53 and 55 of the forming belt 42.

Joined to the reinforcing structure 57 of the forming belt 42 is a plurality of bilaterally staggered protuberances 59. Each protuberance 59 is spaced from the adjacent protuberance on a machine direction pitch of about 24 millimeters (0.096 inches) and a cross machine direction pitch of about 1.3 millimeters (0.052 inches). The protuberances 59 are provided at a density of about 47 protuberances 59 per square centimeter (200 protuberances 59 per square inch).

Each protuberance 59 has a width in the cross machine direction between opposing corners of about 0.9 millimeters (0.036 inches) and a length in the machine direction between opposing corners of about 1.4 millimeters (0.054 inches). The protuberances 59 extend about 0.1 millimeters (0.004 inches) in the Z-direction from the proximal elevation **53*a* of the outwardly oriented face 53 of the reinforcing structure 57 to the free end 53*b* of the protuberance 59**.

Each protuberance 59 has an aperture 63 centered therein and extending from the free end **53*b* of the protuberance 59 to the proximal elevation 53*a* of the protuberance 59 so that the free end 53*b* of the protuberance is in fluid communication with the reinforcing structure 57. Each aperture 63 centered in the protuberance 59 is generally elliptically shaped and may have a major axis of about 0.8 millimeters (0.030 inches) and a minor axis of about 0.5 millimeters (0.021 inches). With the protuberances 59 adjoined to the reinforcing structure 57, the forming belt 42 has an air permeability of about 17,300 standard liters per minute (610 standard cubic feet per minute) and air flow at a differential pressure at about 12.7 millimeters (0.5 inches) of water. The protuberances 59 extend about 0.1 millimeters (0.004 inches) above the face 53*a* of the reinforcing structure 57. This forming belt 42 produces the cellulosic fibrous structure 20 illustrated in FIG. 1**.

As illustrated in FIG. 4, the apparatus further comprises a means 44 for depositing the liquid carrier and entrained cellulosic fibers onto its forming belt 42, and more particularly, onto the face 53 of the forming belt 42 having the discrete upstanding protuberances 59, so that the reinforcing structure 57 and the protuberances 59 are completely covered by the fibrous slurry. A headbox 44, as is well known in the art, may be advantageously used for this purpose. While several types of headboxes 44 are known in the art, one headbox 44 which has been found to work well is a conventional twin wire headbox 44 which generally continuously applies and deposits the fibrous slurry onto the outwardly oriented face 53 of the forming belt 42.

The means 44 for depositing the fibrous slurry and the forming belt 42 are moved relative to one another, so that a generally consistent quantity of the liquid carrier and entrained cellulosic fibers may be deposited on the forming belt 42 in a continuous process. Alternatively, the liquid carrier and entrained cellulosic fibers may be deposited on the forming belt 42 in a batch process. Preferably, the means 44 for depositing the fibrous slurry onto the pervious forming belt 42 can be regulated, so that as the rate of differential movement between the forming belt 42 and the depositing means 44 increases or decreases, larger or smaller quantities of the liquid carrier and entrained cellulosic fibers may be deposited onto the forming belt 42 per unit of time, respectively.

Also, a means **50*a* and/or 50*b* for drying the fibrous slurry from the embryonic cellulosic fibrous structure 20 of fibers to form a two-dimensional cellulosic fibrous structure 20 having a consistency of at least about 90 percent may be provided. Any convenient drying means 50*a* and/or 50*b* well known in the papermaking art can be used to dry the embryonic cellulosic fibrous structure 20 of the fibrous slurry. For example, press felts, thermal hoods, infra-red radiation, blow-through dryers 50*a*, and Yankee drying drums 50*b*, each used alone or in combination, are satisfactory and well known in the art. A particularly preferred drying method utilizes a blow-through dryer 50*a*, and a Yankee drying drum 50*b*** in sequence.

If desired, an apparatus according to the present invention may further comprise an emulsion roll 66, as shown in FIG. 4. The emulsion roll 66 distributes an effective amount of a chemical compound to either forming belt 42 or, if desired, to the secondary belt 46 during the process described above. The chemical compound may act as a release agent to prevent undesired adhesion of the cellulosic fibrous structure 20 to either forming belt 42 or to the secondary belt 46. Further, the emulsion roll 66 may be used to deposit a chemical compound to treat the forming belt 42 or secondary belt 46 and thereby extend its useful life. Preferably, the emulsion is added to the outwardly oriented topographical faces 53 of the forming belt 42 when such forming belt 42 does not have the cellulosic fibrous structure 20 in contact therewith. Typically, this will occur after the cellulosic fibrous structure 20 has been transferred from the forming belt 42, and the forming belt 42 is on the return path.

Preferred chemical compounds for emulsions include compositions containing water, high speed turbine oil known as Regal Oil sold by the Texaco Oil Company of Houston, Tex. under product number R&O 68 Code 702; dimethyl distearyl ammoniumchloride sold by the Sherex Chemical Company, Inc. of Rolling Meadows, Ill. as AOGEN TA100; cetyl alcohol manufactured by the Procter & Gamble Company of Cincinnati, Ohio; and an antioxidant such as is sold by American Cyanamid of Wayne, N.J. as Cyanox 1790. Also, if desired, cleaning showers or sprays (not shown) may be utilized to cleanse the forming belt 42 of fibers and other residues remaining after the cellulosic fibrous structure 20 is transferred from the forming belt 42.

An optional, but highly preferred step in providing a cellulosic fibrous structure 20 according to the present invention is foreshortening the cellulosic fibrous structure 20 after it is dried. As used herein, "foreshortening" refers to the step of reducing the length of the cellulosic fibrous structure 20 by rearranging the fibers and disrupting fiber-to-fiber bonds. Foreshortening may be accomplished in any of several well known ways, the most common and preferred being creping.

The step of creping may be accomplished in conjunction with the step of drying, by utilizing the aforementioned Yankee drying drum **50*b*. In the creping operation, the cellulosic fibrous structure 20 is adhered to a surface, preferably the Yankee drying drum 50*b*, and then removed from that surface with a doctor blade 68 by the relative movement between the doctor blade 68 and the surface to which the cellulosic fibrous structure 20 is adhered. The doctor blade 68 is oriented with a component orthogonal the direction of relative movement between the surface and the doctor blade 68**, and is preferably substantially orthogonal thereto.

Also, a means for applying a differential pressure to selected portions of the cellulosic fibrous structure 20 may be provided. The differential pressure may cause densification or dedensification of the regions 24 and 26 of the cellulosic fibrous structure 20. The differential pressure may be applied to the cellulosic fibrous structure 20 during any step in the process before too much of the liquid carrier is drained away, and is preferably applied while the cellulosic fibrous structure 20 is still an embryonic cellulosic fibrous structure 20. If too much of the liquid carrier is drained away before the differential pressure is applied, the fibers may be too stiff and not sufficiently conform to the topography of the patterned array of protuberances 59, thus yielding a cellulosic fibrous structure 20 that does not have the described regions of differing density.

If desired, the regions 24 and 26 of the cellulosic fibrous structure 20 may be further subdivided according to density. Particularly, certain of the high basis weight regions 24 or certain of the low basis weight regions 26 may be densified or dedensified. This may be accomplished by transferring the cellulosic fibrous structure 20 from the forming belt 42 to a secondary belt 46 having projections which are not coincident the discrete protuberances 59 of the forming belt 42. During or after the transfer, the projections of the secondary belt 46 compress the certain sites of the regions 24 and 26 of the cellulosic fibrous structure 20, causing densification of such sites to occur. 0f course, a greater degree of densification will be imparted to the sites in the high basis weight regions 24, than to the sites of the low basis weight regions 26.

When selected sites are compressed by the projections of the secondary belt 46, such sites are densified and have greater fiber to fiber bonding. Such bonding increases the tensile strength of such sites, and generally increases the tensile strength of the entire cellulosic fibrous structure 20. Preferably, the densification occurs before too much of the liquid carrier is drained away, and the fibers become too stiff to conform to the topography of the patterned array of protuberances 59.

Alternatively, selected sites of the various regions 24 and 26 may be dedensified, increasing the caliper and absorbency of such sites. Dedensification may occur by transferring the cellulosic fibrous structure 20 from the forming belt 42 to a secondary belt 46 having vacuum pervious regions not coincident the protuberances 59 or the various regions 24 and 26 of the cellulosic fibrous structure 20. After transfer of the cellulosic fibrous structure 20 to the secondary belt 46, a differential fluid pressure, either positive or subatmospheric, is applied to the vacuum pervious regions of the secondary belt 46. The differential fluid pressure causes deflection of the fibers of each site coincident the vacuum pervious regions to occur in a plane normal to the secondary belt 46. By deflecting the fibers of the sites subjected to the differential fluid pressure, the fibers move away from the plane of the cellulosic fibrous structure 20 and increase the caliper thereof.

THE PROCESS

The cellulosic fibrous structure 20 according to the present invention may be made according to the process comprising the following steps. The first step is to provide a plurality of cellulosic fibers entrained in a liquid carrier. The cellulosic fibers are not dissolved in the liquid carrier, but merely suspended therein. Also provided is a liquid pervious fiber retentive forming element 42, such as a forming belt 42. The forming element 42 has fluid pervious zones 63 and 65 and upstanding protuberances 59. Also provided is a means 44 for depositing the liquid carrier and entrained cellulosic fibers onto the forming element 42.

The forming belt 42 has high flow rate and low flow rate liquid pervious zones respectively defined by annuluses 65 and apertures 63. The forming belt 42 also has upstanding protuberances 59.

The liquid carrier and entrained cellulosic fibers are deposited onto the forming belt 42 illustrated in FIG. 6. The liquid carrier is drained through the forming belt 42 in two simultaneous stages, a high flow rate stage and a low flow rate stage. In the high flow rate stage, the liquid carrier drains through the liquid pervious high flow rate zones at a given initial flow rate until obturation occurs (or the liquid carrier is no longer introduced to this portion of the forming belt 42). In the low flow rate stage, the liquid carrier drains through low flow rate zones of the forming element 42 at a given initial flow rate which is less than the initial flow rate through the high flow rate zones.

Of course the flow rates through both the high and low flow rate zones in the forming belt 42 decrease as a function of time, due to expected obturation of both zones. Without being bound by theory, the low flow rate zones may obturate before the high flow rate zones obturate.

Without being bound by theory, the first occurring zone obturation may be due to the lesser hydraulic radius and greater flow resistance of such zones, based upon factors such as the flow area, wetted perimeter, shape and distribution of the low flow rate zones, or may be due to a greater flow rate through such zone accompanied by a greater depiction of fibers. The low flow rate zones may, for example, comprise apertures 63 through the protuberances 59, which apertures 63 have a greater flow resistance than the liquid pervious annuluses 65 between adjacent protuberances 59.

During both stages of draining, certain cellulosic fibers are simultaneously orientationally influenced by both the high and low flow rate zones. These influences result in a radially oriented bridging of the fibers across the surface of the protuberance 59 which has infinite flow resistance. This radial bridging spans the high basis weight region 24 throughout each discrete low basis weight region 26. The low flow rate zone provides the orientational influence for such bridging to occur without excessive accumulation of fibers at the centroid of the low flow rate zone and minimizes or prevents an intermediate basis weight region 25 from occurring.

It is important that the ratio of the flow resistances between the apertures 63 and the annuluses 65 be properly proportioned. If the flow resistance through the apertures 63 is too small, an intermediate basis weight region 25 may be formed and generally centered in the low basis weight region 24. This arrangement will result in a three region cellulosic fibrous structure 20. Conversely, if the flow resistance is too great, a low basis weight region having a random, or other nonradial, distribution of fibers may occur.

The flow resistance of the apertures 63 and the annuluses 65 may be determined by using the hydraulic radius, as set forth above. Based upon the examples analyzed below, the ratio of the hydraulic radii of the annuluses 65 to the apertures 63, should be at least about 2 for a forming element 42 having about 5 to about 31 protuberances 59 per square centimeter (30 to 200 protuberances 59 per square inch). It would be expected that a lower ratio of hydraulic radii, say at least about 1.1, would be suitable for a forming element 42 having more than 31 protuberances 59 per square centimeter (200 protuberances 59 per square inch) up to a pattern of about 78 protuberances 59 per square centimeter (500 protuberances 59 per square inch).

Table I illustrates the geometry of five forming elements 42 used to form examples of the cellulosic fibrous structures 20 which are analyzed in more detail below. Referring to the first column in Table I, the area of the annuluses 65, as a percentage of the total surface area of the forming element 42, is either 30 percent or 50 percent. As illustrated in the second column, the surface area of the apertures 63, as a percentage of the total surface area of the forming element 42, is from 10 percent to 20 percent. The third column gives the extent of the protuberances 59 above the reinforcing structure 57. In the fourth column, the theoretical ratio of the hydraulic radii of the annuluses 65 to the apertures 63 is calculated, as set forth above. In the fifth column, the actual ratio of the hydraulic radius is calculated, as set forth below.

The actual hydraulic radii, and hence the ratio thereof, were iteratively calculated from the air permeabilities of the forming element 42 with and without the protuberances 59. While a theoretical protuberance 59 size, and hence hydraulic radius, can be easily found from the drawings used to construct the forming element 42, due to variations inherent in the manufacturing process, the actual size will vary somewhat.

The actual sizes of the protuberances 59, and hence annuluses 65 and apertures 63, were approximated by comparing the air permeability of the reinforcing structure 57 without protuberances 59, to the air permeability of the belt 42 with the protuberances 59. The actual air permeability is easily measured using known techniques and was less than that obtained by considering the theoretical deduction of the protuberances 59 from the flow area through the reinforcing structure 57.

By knowing the difference between the actual and theoretical air permeabilities of the forming element 42 with the protuberances 59 in place, the actual size of the protuberances 59 necessary to give such actual air flow can be found using conventional mathematics in an iterative fashion, assuming the walls of the protuberances 59 taper equally towards the annuluses 65 and the apertures 63.

TABLE I

| Annulus Open Area (percentage) | Aperture Open Area (percentage) | Protuberance Extent (inches) | Theoretical Ratio of Hydraulic Radius of Annulus to Hydraulic Radius of Aperture | Actual Ratio of Hydraulic Radius of Annulus to Hydraulic Radius of Aperture |
|---|---|---|---|---|
| 50 | 10 | 4.6 | 2.15 | 2.05 |
| 50 | 15 | 8.3 | 1.76 | 1.50 |
| 50 | 20 | 2.2 | 1.52 | 1.27 |
| 30 | 10 | 2.7 | 1.10 | 0.77 |
| 30 | 20 | 2.9 | 0.78 | 0.52 |

Each of the forming elements 42 had 31 protuberances 59 per square centimeter (200 protuberances 59 per square inch). Of course, the ratio of the hydraulic radii is independent of the size of the protuberances 59 and annuluses 65, as only the ratio of the flow area to wetted perimeter of the unit cell which is considered, which ratio remains constant as the unit cell is enlarged or reduced in size.

The range of hydraulic radii of 0.52 to 1.27 is used for the forming elements 42 used to construct the various examples of cellulosic fibrous structures 20 given in Table II below. A forming element 42 having a hydraulic radius ratio of 2.05 is used to construct each example of the cellulosic fibrous structure 20 illustrated in Table III below.

From these examples, it is believed a forming element 42 having a hydraulic radius ratio of at least about 2 has been found to work well. Of course, the mass flow rate ratio is related to at least a second order power of the hydraulic radius ratio, and a mass flow rate ratio of at least 2, and possibly greater than 4, depending upon the Reynolds number, would be expected to work well.

Prophetically, a hydraulic radius ratio as low as 1.25 could be utilized with a forming element 42 according to the present invention, providing other factors are adjusted to compensate for such lower ratio. For example, the absolute velocity of the forming element 42 could be increased, or the relative velocities between the forming element 42 and the liquid carrier could be matched at near a 1.0 velocity ratio.

Also, utilizing shorter length fibers, such as Brazilian eucalyptus, would be helpful in producing cellulosic fibrous structures 20 according to the present invention.

For example, a suitable cellulosic fibrous structure 20 according to the present invention has been made utilizing a forming element 42 having a hydraulic radius ratio of 1.50. The absolute velocity of the forming element 42 was about 262 meters per minute (800 feet per minute) and the velocity ratio between the liquid carrier and the forming element 42 was about 1.2. The forming element 42 had 31 protuberances 59 per square centimeter (200 protuberances 59 per square inch) The protuberances 59 occupied about 50 percent of the total surface area of the forming element 42 and the apertures 63 therethrough occupied about 15 percent of the surface area of the forming element 42. The resulting cellulosic fibrous structure 20 was made with about 60 percent northern softwood Kraft and about 40 percent chemi-thermo-mechanical softwood pulp (CTMP), both having a fiber length of about 2.5 to about 3.0 millimeters. The resulting cellulosic fibrous structure 20 had about 25 percent of the low basis weight regions 26 falling within both criteria set forth above.

ILLUSTRATIVE EXAMPLES

Several nonlimiting illustrative cellulosic fibrous structures 20 were made utilizing different parameters as illustrated in Table II. All samples were made on an S-wrap twin wire forming machine using a 35.6×35.6 centimeter (14×14 inch) square sample forming element 42 superimposed on a conventional 84M four shed satin weave forming wire fed through the nip and conventionally dried. All of these cellulosic fibrous structures 20 were made using a forming element 42 having a velocity of about 244 meters per minute (800 feet per minute) and with the liquid carrier impinging upon the forming element 42 at a velocity about 20 percent greater than that of the forming element 42. The resulting cellulosic fibrous structures 20 each had a basis weight of about 19.5 grams per square meter (12 pounds per 3,000 square feet).

The second column shows the examples in Table II were constructed using a protuberance 59 size of either 5 protuberances 59 per square centimeter (30 protuberances 59 per square inch) or 31 protuberances 59 per square centimeter (200 protuberances 59 per square inch). The third column shows the percentage open area in the annuluses 65 between adjacent protuberances 59 to be either 10 or 20 percent. The fourth column shows the size of the aperture 63 cross sectional area as a percentage of the protuberance 59 cross sectional area. The fifth column shows the extent of the distal ends **53*b* of the protuberances 59 above the reinforcing structure 57** to be from about 0.05 millimeters (0.002 inches) to about 0.2 millimeters (0.008 inches). The sixth column shows the fiber type to be either northern softwood Kraft having a fiber length of about 2.5 millimeters or Brazilian eucalyptus having a fiber length of about 1 millimeter.

All of the resulting cellulosic fibrous structures 20 were examined without magnification and with magnifications of 50× and 100×. The samples were qualitatively judged by two criteria: 1) the presence of two regions 24 and 26, three regions 24, 26 and an intermediate basis weight region 25 generally centered within the low basis weight region 26; and 2) the radiality of the fibers. Radiality was judged on the bases of the symmetry of the fiber distribution and the presence or absence of nonradially oriented (tangential or circumferential) fibers.

The last column shows the classification of the resulting cellulosic fibrous structure 20. Each cellulosic fibrous structure 20 in the examples illustrated in Table II was subjectively classified, using the aforementioned criteria, into the following categories:

| | |
|---|---|
| 2 region paper having radially oriented fibers in the low basis weight regions 26 (FIG. $3D_3$) | (2 Region) |
| Borderline 3 region paper having radially oriented fibers in the low basis weight regions 26 (FIG. $2B_2$ or FIG. $3C_1$) | (Borderline 3 Region) |
| Paper having a borderline random distribution of the fibers in the low basis weight regions 26 (FIG. $2D_2$ or FIG. $3B_2$) | (Borderline Random) |
| Paper having 3 regions of differing basis weights (FIG. $2A_2$ or FIG. $2A_3$) | (3 Region) |
| Two basis weight paper having a random orientation of fibers in the low basis weight regions 26 (FIG. $3A_3$) | (Random) |
| Paper having apertures in the low basis weight regions 26 (FIG. $2A_1$) | (Apertured) |
| Unable to produce the desired paper under the specified conditions due to insufficient emulsion | (Did not produce) |

Of course, an exemplary cellulosic fibrous structure 20 could be placed in more than one classification, depending upon which criterion applied. If only one criterion is listed, the other criterion was judged to be satisfied as meeting the conditions of a cellulosic fibrous structure 20 according to the present invention.

TABLE II

| Example | Protuberance Size (protuberances per square inch) | Annulus Open Area (percentage) | Aperture Open Area (percentage) | Protuberance Extent (inches) | Fiber Type | Classification |
|---|---|---|---|---|---|---|
| 1 | 200 | 50 | 10 | 0.008 | NSK | 2 Region |
| 2 | 200 | 30 | 20 | 0.003 | NSK | Borderline 3 Region/Borderline Random |
| 3 | 200 | 30 | 10 | 0.008 | Euc | Borderline Random |
| 4 | 30 | 30 | 10 | 0.003 | NSK | Did not produce |
| 5 | 30 | 50 | 20 | 0.003 | Euc | 3 Region |
| 6 | 200 | 30 | 10 | 0.003 | Euc | Did not produce |
| 7 | 30 | 30 | 20 | 0.008 | NSK | 3 Region |
| 8 | 30 | 50 | 10 | 0.002 | Euc | Apertured |
| 9 | 30 | 30 | 20 | 0.008 | Euc | Random |
| 10 | 30 | 50 | 10 | 0.008 | NSK | 3 Region |
| 11 | 200 | 50 | 20 | 0.008 | Euc | Random |
| 12 | 200 | 50 | 20 | 0.003 | NSK | Borderline Random/Borderline 3 Region |

TABLE II-continued

| Example | Protuberance Size (protuberances per square inch) | Annulus Open Area (percentage) | Aperture Open Area (percentage) | Protuberance Extent (inches) | Fiber Type | Classification |
|---|---|---|---|---|---|---|
| 13 | 200 | 50 | 10 | 0.002 | Euc | Borderline 3 Region/Borderline Random |
| 14 | 30 | 50 | 10 | 0.002 | NSK | 3 Region |

Referring to Table III, additional exemplary cellulosic fibrous structures 20 were made on the same twin wire forming machine, using full size forming wires and through air dried. The forming element 42 had about 31 protuberances 59 per square centimeter (200 protuberances 59 per square inch), each extending about 0.1 millimeters (0.004 inches) above the reinforcing structure 57. The protuberances 59 occupied about 50 percent of the surface area of the forming element 42, and the apertures 63 occupied about 10 percent of the surface area of the forming element 42.

As illustrated in the second column, the ratio of the velocity of the liquid carrier to the velocity of the forming element 42 was either 1.0 or 1.4. As illustrated in the third column, the liquid carrier either had an impingement of about 0 percent or 20 percent of its surface area onto a roll supporting the forming element 42. As illustrated in the fourth column, the resulting cellulosic fibrous structure 20 had a basis weight of either about 19.5 or about 25.4 grams per square meter (12.0 or 15.6 pounds per 3,000 square feet). As illustrated in the fifth column, the same fibers discussed above relative to Table II were utilized. As illustrated in the sixth column, the forming element 42 had a velocity of either 230 or 295 meters per minute (700 or 900 feet per minute). As illustrated in the last column, the same criteria applied in classifying the resulting cellulosic fibrous structures 20.

TABLE III

| Example | Liquid Carrier to Forming Element Velocity Ratio | Liquid Carrier Impingement on Roll Supporting Forming Wire (percentage) | Basis Weight (lbs. per 3,000 square feet) | Fiber Type | Forming Element Speed (feet per minute) | Classification |
|---|---|---|---|---|---|---|
| 1 | 1.0 | 20 | 12.0 | Euc | 700 | 2 Region |
| 2 | 1.4 | 20 | 12.0 | Euc | 700 | 3 Region |
| 3 | 1.0 | 20 | 15.6 | Euc | 700 | Borderline Random |
| 4 | 1.4 | 20 | 15.6 | Euc | 700 | 3 Region |
| 5 | 1.0 | 20 | 12.0 | Euc | 900 | 2 Region |
| 6 | 1.4 | 20 | 12.0 | Euc | 900 | 3 Region |
| 7 | 1.0 | 20 | 15.6 | Euc | 900 | 2 Region |
| 8 | 1.4 | 20 | 15.6 | Euc | 900 | 3 Region |
| 9 | 1.0 | 20 | 12.0 | NSK | 700 | Borderline Random |
| 10 | 1.4 | 20 | 12.0 | NSK | 700 | Borderline 3 Region |
| 11 | 1.0 | 20 | 15.6 | NSK | 700 | 2 Region |
| 12 | 1.4 | 20 | 15.6 | NSK | 700 | Borderline Random/ Borderline 3 Region |
| 13 | 1.0 | 20 | 12.0 | NSK | 900 | Borderline Random |
| 14 | 1.4 | 20 | 12.0 | NSK | 900 | Borderline 3 Region |
| 15 | 1.0 | 20 | 15.6 | NSK | 900 | Borderline Random |
| 16 | 1.4 | 20 | 15.6 | NSK | 900 | Borderline 3 Region |
| 17 | 1.0 | 0 | 12.0 | Euc | 700 | 2 Region |
| 18 | 1.4 | 0 | 12.0 | Euc | 700 | 3 Region |
| 19 | 1.0 | 0 | 15.6 | Euc | 700 | Borderline 3 Region |
| 20 | 1.4 | 0 | 15.6 | Euc | 700 | 3 Region |
| 21 | 1.0 | 0 | 12.0 | Euc | 900 | 2 Region |
| 22 | 1.4 | 0 | 12.0 | Euc | 900 | 3 Region |
| 23 | 1.0 | 0 | 15.6 | Euc | 900 | 2 Region |
| 24 | 1.4 | 0 | 15.6 | Euc | 900 | 3 Region |
| 25 | 1.0 | 0 | 12.0 | NSK | 700 | Borderline Random |
| 26 | 1.4 | 0 | 12.0 | NSK | 700 | Borderline 3 Region |
| 27 | 1.0 | 0 | 15.6 | NSK | 700 | Random |
| 28 | 1.4 | 0 | 15.6 | NSK | 700 | Borderline Random/ Borderline 3 Region |
| 29 | 1.0 | 0 | 12.0 | NSK | 900 | Borderline Random |
| 30 | 1.4 | 0 | 12.0 | NSK | 900 | Borderline Random |
| 31 | 1.0 | 0 | 15.6 | NSK | 900 | Borderline Random |
| 32 | 1.4 | 0 | 15.6 | NSK | 900 | Borderline 2 Region |

As will be seen upon examination of Table III, generally, the liquid carrier velocity to forming element 42 velocity ratio was the most significant factor of determining the classification of these resulting cellulosic fibrous structures 20. Typically a velocity ratio of 1.0 generally worked well with eucalyptus fibers, while a velocity ratio of 1.4 generally worked well with northern softwood Kraft fibers. The velocity of the forming element 42 was a somewhat less significant factor in determining the classification of the resulting cellulosic fibrous structures 20. Generally, as the velocity of the forming element 42 decreased, so did the tendency for a random fiber distribution within the low basis weight regions 26.

Furthermore, it is apparent that the resulting cellulosic fibrous structures 20 are significantly influenced by the type of fibers utilized. Typically, the cellulosic fibrous structures 20 having eucalyptus fibers were more sensitive to the velocity of the liquid carrier to the forming element 42, resulting in either good two-region cellulosic fibrous structures 20 having radially oriented fibers in the low basis weight region 26, or resulting in unacceptable three-region cellulosic fibrous structures 20. More cellulosic fibrous structures 20 having a borderline three region formation or borderline random fiber distributions within the low basis weight regions 26 occurred when the northern softwood Kraft fibers were utilized.

VARIATIONS

Figure 7B:
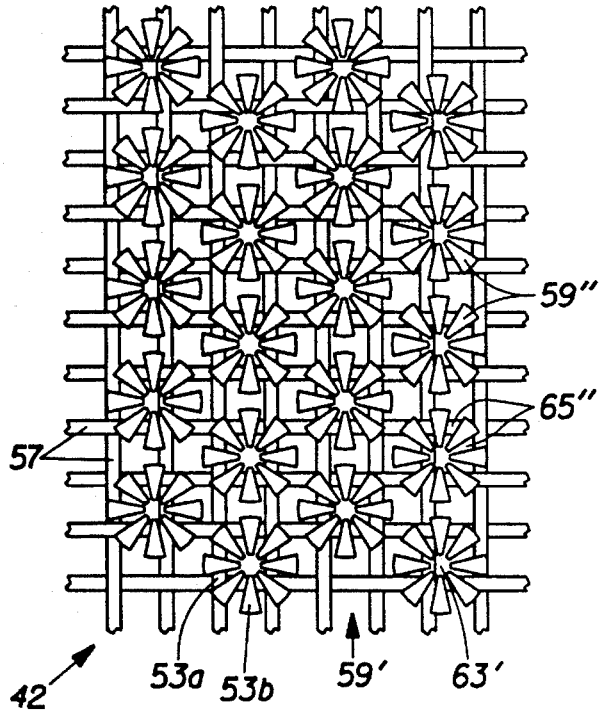
FIGS. 7A and 7B are schematic top plan views of an alternative embodiment of a forming element which may be used to make cellulosic fibrous structures according to the present invention and having radially segmented protuberances.
Figure 7A:
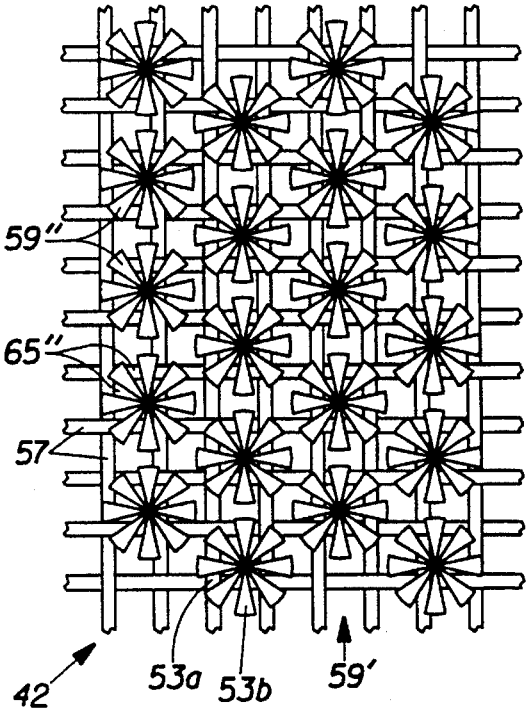

Instead of cellulosic fibrous structures 20 made on a forming element 42 having protuberances 59 with apertures 63 therethrough, prophetically cellulosic fibrous structures 20 having low basis weight regions 26 with radially oriented fibers may be made on a forming belt 42 as illustrated in FIGS. 7A and 7B. In this forming element 42, the protuberances 59' are radially segmented and define annuluses 65" intermediate the radially oriented segments 59".

As illustrated in FIG. 7A, the radial segments 59" may be connected at or near the centroid, to help prevent an intermediate basis weight region 25 from being formed. This arrangement allows the cellulosic fibers to flow through the annuluses 65" intermediate the radial segments 59" in a radial pattern, and to bridge the centroid of the radial segments 59".

Alternatively, as illustrated in FIG. 7B the radial segments 59" may be separated at the centroid aperture 63' to allow unimpeded flow towards the centroid of the low flow rate zone. This arrangement provides the advantage that it is not necessary to bridge the centroid of the radial segments 59" of protuberances 59' using this variation, but instead, radial flow may progress without obstruction.

In a specific embodiment, as illustrated by FIGS. 7A and 7B, the radial segments 59" may comprise sectors of a circle. Alternatively, the radial segments 59" may collectively be noncircular, but convergent as the centroid of the low flow rate zone is approached.

It will be apparent to one skilled in the art that many other variations and combinations can be performed within the scope of the claimed invention. All such variations and combinations are included within the scope of the appended claims.

What is claimed is:

1. A single lamina cellulosic fibrous structure having a machine direction and a cross machine direction orthogonal thereto, and consisting essentially of two regions disposed in a nonrandom, repeating pattern, said cellulosic fibrous structure consisting essentially of a first region, of a relatively high basis weight and comprising an essentially continuous network; and a plurality of mutually discrete second regions comprising a relatively low basis weight and being circumscribed by said first region, said second regions being comprised of a plurality of substantially radially oriented fibers, said radially oriented fibers being disposed in said machine direction, in said cross machine direction, and in spaced angular relationship therebetween.

2. A cellulosic fibrous structure according to claim 1 wherein said plurality of low basis weight regions comprises at least about 10 percent of the total number of low basis weight regions within said cellulosic fibrous structure.

3. A cellulosic fibrous structure according to claim 2 wherein said plurality of low basis weight regions comprises at least about 20 percent of the total number of low basis weight regions within said cellulosic fibrous structure.

4. A cellulosic fibrous structure according to claim 2 wherein said basis weight of said high basis weight region is at least about 25 percent greater than said basis weight of said low basis weight region.

5. A cellulosic fibrous structure according to claim 4 comprising at least three regions, wherein said first region of a relatively high basis weight comprises high basis weight regions having mutually different densities.

6. A cellulosic fibrous structure according to claim 2 wherein said radially oriented fibers of said low basis weight region are disposed in at least four quadrants of said low basis weight region.

7. A single lamina cellulosic fibrous structure having a machine direction and a cross machine direction orthogonal thereto, and consisting essentially of two regions disposed in a nonrandom, repeating pattern:

a first region of a relatively high basis weight and comprising an essentially continuous load bearing network region; and a plurality of mutually discrete second regions, each said second region comprising a quality of fewer fibers per unit area than said first region, said fewer fibers within each of said second regions radially bridging said second region to said first region, said radially bridging fibers being disposed in said machine direction, in said cross machine direction, and in spaced angular relationship therebetween.

* * * * *

UNITED STATES PATENT AND TRADEMARK OFFICE

CERTIFICATE OF CORRECTION

PATENT NO. : 5,534,326

DATED : July 9, 1996

INVENTOR(S) : Paul D. Trokhan et al.

It is certified that error appears in the above-indentified patent and that said Letters Patent is hereby corrected as shown below:

Column 22, line 1, delete " Of " and insert -- Of --.

Signed and Sealed this

Twenty-second Day of April, 1997

Bruce Lehman

*Attest:*

BRUCE LEHMAN

*Commissioner of Patents and Trademarks*

*Attesting Officer*